US008267506B2

(12) United States Patent
Kuwahara et al.

(10) Patent No.: US 8,267,506 B2
(45) Date of Patent: Sep. 18, 2012

(54) INK JET PRINTER DEVICE AND HUMIDIFICATION METHOD OF EJECTION PORTION

(75) Inventors: Soichi Kuwahara, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 328 days.

(21) Appl. No.: 12/565,455

(22) Filed: Sep. 23, 2009

(65) Prior Publication Data

US 2010/0079515 A1 Apr. 1, 2010

(30) Foreign Application Priority Data

Sep. 26, 2008 (JP) ..... 2008-248699

(51) Int. Cl.
*B41J 2/01* (2006.01)

(52) U.S. Cl. ..... 347/102

(58) Field of Classification Search ..... 347/7, 14, 347/17, 19, 102, 104
See application file for complete search history.

(56) References Cited

U.S. PATENT DOCUMENTS 5,774,155 A * 6/1998 Medin et al. ..... 347/102
7,300,146 B2 * 11/2007 Roberts ..... 347/101

FOREIGN PATENT DOCUMENTS

JP 64-071756 3/1989
JP 2006-281539 10/2006

* cited by examiner

*Primary Examiner* — An Do
(74) *Attorney, Agent, or Firm* — SNR Denton US LLP

(57) ABSTRACT

An inkjet printer device includes: an ejection portion that ejects an ink droplet onto a recording medium; a humidification portion that is provided upstream of the ejection portion in a transportation direction of the recording medium and ejects a wetting liquid droplet onto the recording medium; and a control portion that makes the ink droplet be ejected onto the recording medium from the ejection portion and the wetting liquid droplet be ejected onto the recording medium from the humidification portion, wherein the ejection portion is humidified during printing by letting the wetting liquid droplet ejected onto the recording medium evaporate from the recording medium.

10 Claims, 15 Drawing Sheets

INK JET PRINTER DEVICE AND HUMIDIFICATION METHOD OF EJECTION PORTION

BACKGROUND OF THE INVENTION

1. Field of the Invention

The present invention relates to an ink jet printer device that prints printed matter without smearing while preventing an ejection failure caused by drying or thickening of an ink by humidifying an ejection portion during printing and a humidification method of an ejection potion.

2. Description of Related Art

As a device that ejects ink droplets, there is an ink jet type printer device (hereinafter, referred to simply as the ink jet printer device) configured to print an image and characters by making ink droplets be ejected onto a recording sheet as a recording medium from the head cartridge. The ink jet printer device has advantages that the running costs are low and it is easy to reduce the size of the device and to color a print image. In the ink jet printer device, inks of a plurality of colors (for example, yellow, magenta, cyan, black, and so forth) filled in the corresponding ink cartridges are supplied to the ink liquid chambers of the head cartridge.

The ink supplied to the ink liquid chamber of the head cartridge from the corresponding ink cartridge is pressed by a pressure generated by a pressure generation element, such as a heat resistor, provided inside the ink liquid chamber. The ink within the ink liquid chamber is consequently ejected from a fine nozzle provided to the head cartridge. In the following, a case where the heat resistor is used will be described concretely. The ink within the ink liquid chamber is heated by the heat resistor provided inside the ink liquid chamber to generate an air bubble on the heat resistor and an ink droplet is ejected from the nozzle by a pressure generated by this air bubble. The ink droplet thus ejected is allowed to land on a recording sheet as a recording medium to print an image and characters thereon.

The ink jet printer device configured as above possibly fails to eject an ink droplet during the printing because the ink dries or thickens at the ejection portion. To eliminate such an inconvenience, it is general to prevent drying of the ink by placing a cap on the ejection surface when not in use for printing or to remove the dried or thickened ink by ejecting tens to hundreds of ink droplets onto a non-print region immediately before the printing.

By removing the dried or thickened ink by the processing as above, the ink jet printer device becomes able to eject ink droplets from all the ejection portions when the printing starts. However, even when the ink jet printer device is in such a state when the printing starts, the ink gradually dries or thickens during the printing at an ejection portion that is seldom used during the printing.

Accordingly, when the ink jet printer device makes ink droplets be ejected nearly at the end of the printing from an ejection portion that has been seldom used during the printing, an ejection failure may possibly occur because the ink has dried or thickened.

Also, in order to avoid this problem, a type of a serial head ink jet printer device is provided with a portion that ejects ink droplets onto non-print regions on the both sides of a recording sheet when the head comes to the non-print regions. With this configuration, the serial head ink jet printer device prevents drying and thickening at a seldom used ejection portion.

On the contrary, it is difficult for a line head ink jet printer device to eject ink droplets onto the non-print regions in the middle of printing, which makes it difficult to print printed matter having a long print length.

An idea to humidify the ejection portion so as to prevent drying or thickening of an ink has been proposed in JP-A-2006-281539 before the present invention. This cited reference proposes a method of preventing drying and thickening at the ejection portion by wetting the ejection surface by pushing out the ink from the ejection portion while humidifying the vicinity of the ejection portion using a humidifier.

According to this humidification method, it is possible to humidify the ejection portion when not in use for printing but it is quite difficult to humidify the ejection portion during the printing.

Also, JP-A-64-71756 proposes a method of preventing drying and thickening at the ejection portion by impregnating a recording medium with moisture using a humidifier roller and heating the recording medium using a heating portion for letting the moisture evaporate from the recording medium. According to this method, it is possible to humidify the ejection portion during the printing. However, it is difficult to control an amount of humidification and smearing may possibly occur depending on the content of the printing.

SUMMARY OF THE INVENTION

It is desirable to provide an inkjet printer device not only capable of preventing an ejection failure caused by drying or thickening of an ink by humidifying an ejection portion during the printing but also capable of printing printed matter without smearing and a humidification method of an ejection portion.

According to an embodiment of the present invention, there is provided an ink jet printer device including an ejection portion that ejects an ink droplet onto a recording medium, a humidification portion that is provided upstream of the ejection portion in a transportation direction of the recording medium and ejects a wetting liquid droplet onto the recording medium, and a control portion that makes the ink droplet be ejected onto the recording medium from the ejection portion and the wetting liquid droplet be ejected onto the recording medium from the humidification portion. The ejection portion is humidified during printing by letting the wetting liquid droplet ejected onto the recording medium evaporate from the recording medium.

Also, according to another embodiment of the present invention, there is provided a humidification method including the steps of ejecting a wetting liquid droplet onto a recording medium from a humidification portion, and humidifying an ejection portion during printing by letting the wetting liquid droplet ejected onto the recording medium evaporate from the recording medium.

According to the embodiments of the present invention, by ejecting the wetting liquid droplet onto the recording medium from the humidification portion and by letting the wetting liquid droplet ejected onto the recording medium evaporate from the recording medium, the ejection portion can be humidified during the printing. It thus becomes possible to prevent an ejection failure and the curving of an ejection direction caused by drying or thickening of the ink at the ejection portion during the printing.

Also, according to the embodiments of the present invention, because the control portion is able to control an amount of humidification and the striking method of the wetting liquid droplet to be ejected from the humidification portion, it is possible to prevent smearing of the ink.

DESCRIPTION OF THE PREFERRED EMBODIMENTS

Hereinafter, an ink jet printer device (hereinafter, referred to as the printer device) 1 to which the present invention is applied will be described concretely with reference to the drawings.

Figure 1:
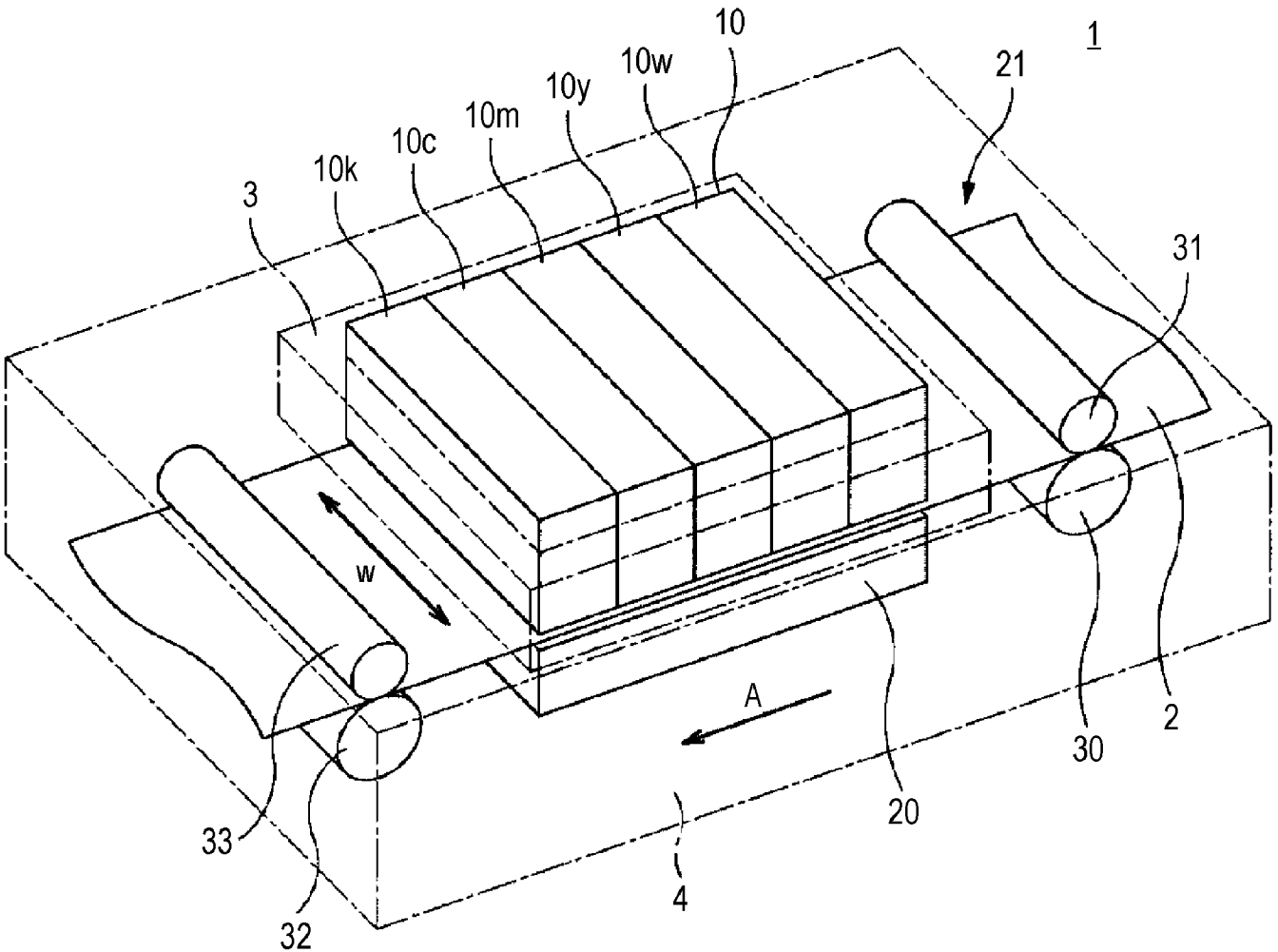
FIG. 1 is a perspective view schematically showing a printer device to which the present invention is applied.
Figure 2:
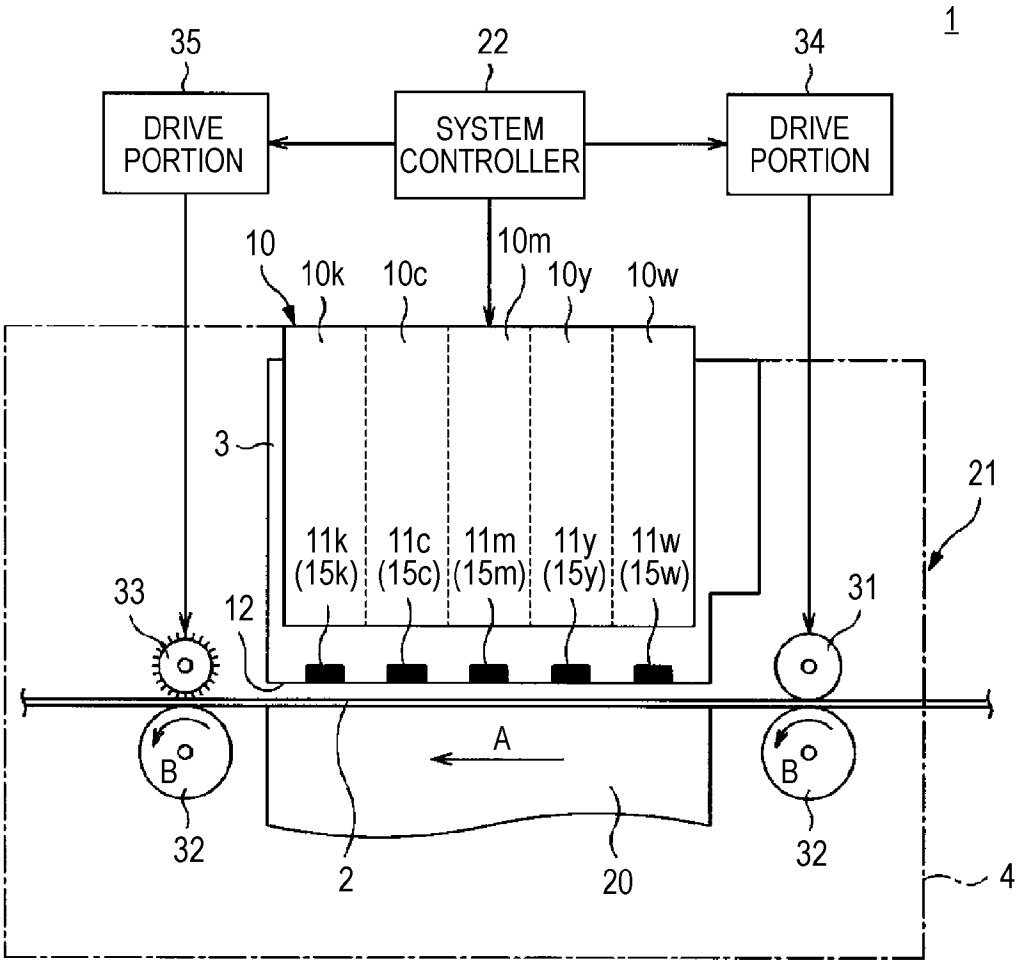
FIG. 2 is a front view schematically showing the printer device to which the present invention is applied.

As are shown in FIG. 1 and FIG. 2, the printer device 1 to which the present invention is applied is a multi-line head type printer device in which ejection portions, that is, so-called nozzles 13, of respective colors are provided side by side substantially linearly in the width direction of a recording sheet 2 as a recording medium, that is, in a direction indicated by an arrow W of FIG. 1. To be more concrete, the printer device 1 records characters and an image made up of ink dots on the recording sheet 2 according to print data, such as character data and image data, inputted therein from an information processing device, for example, a personal computer, by making an ink be ejected so as to land on the recording sheet 2 being transported in a predetermined direction.

The printer device 1 includes a head cartridge 3 that ejects an ink onto the recording sheet 2 and a device main body 4 to which the head cartridge 3 is attached.

As are shown in FIG. 1 and FIG. 2, an ink cartridge 10*y* filled with a yellow (Y) ink, an ink cartridge 10*m* filled with a magenta (M) ink, an ink cartridge 10*c* filled with a cyan (C) ink, and an ink cartridge 10*k* filled with a black (K) ink, and an ink cartridge 10*w* filled with a wetting liquid (W) (hereinafter, these cartridges are also referred to simply as the ink cartridges 10) are attached to the head cartridge 3 forming the printer device 1. To be more concrete, the wetting liquid ink cartridge 10*w*, the yellow ink cartridge 10*y*, the magenta ink cartridge 10*m*, the cyan ink cartridge 10*c*, and the black ink cartridge 10*k* are provided to the head cartridge 3 in this order and aligned side by side from upstream to downstream in the transportation direction of the recording sheet 2, that is, in a direction indicated by an arrow A of FIG. 1 and FIG. 2.

The head cartridge 3 is configured in such a manner that inks of the respective colors and the wetting liquid are supplied to unillustrated ink liquid chambers of the head cartridge 3 from the ink cartridges 10 filled with the inks of the respective colors and the wetting liquid. The head cartridge 3 heats the inks of the respective colors and the wetting liquid in the ink liquid chambers using heat resistors 11*w*, 11*y*, 11*m*, 11*c*, and 11*k* (hereinafter, referred also to simply as heat resistors 11), which are pressure generation elements disposed inside the ink liquid chambers to generate air bubbles in the inks of the respective colors and the wetting liquid on the heat resistors 11, so that the ink droplets and wetting liquid droplets w are ejected from nozzles 13 by a pressure generated by the air bubbles.

The wetting liquid referred to herein is a colorless and transparent liquid obtained by removing a dye component or a pigment component from generally used inks made of a mixture of a solvent and the dye component or a solvent and the pigment component and any other additive added to the mixture. Alternatively, the wetting liquid may be a colorless and transparent liquid, such as pure water and water with addition of a fungicide or the like.

Figure 3:
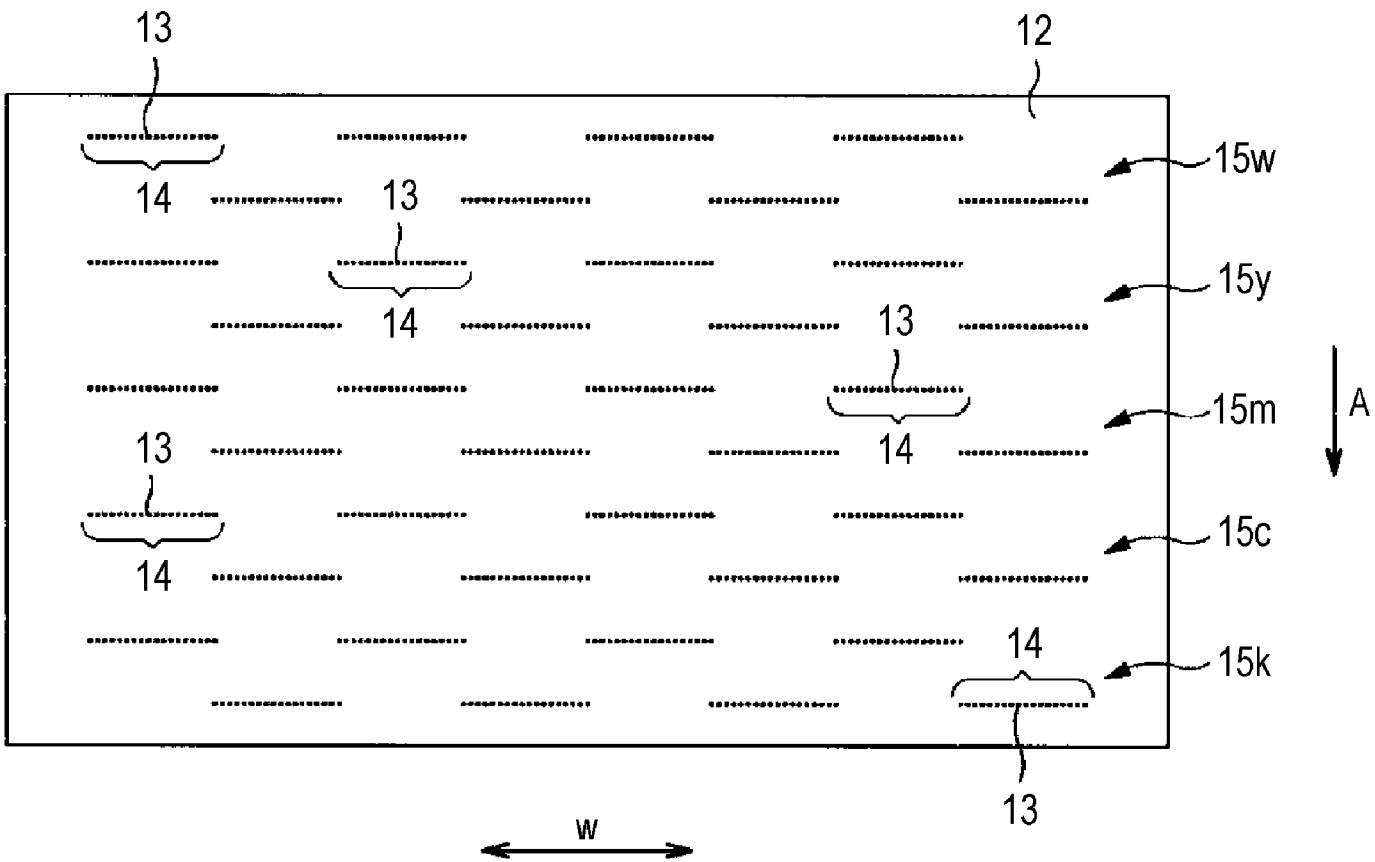
FIG. 3 is a plan view showing an ejection surface of a head cartridge.

As is shown in FIG. 3, an ejection surface 12 of the head cartridge 3 from which ink droplets and wetting liquid droplets w are ejected is provided with the nozzles 13 that eject ink droplets and wetting liquid droplets w. A plurality of the nozzles 13 form one unit 14 (hereinafter, referred to as the nozzle unit 14). The nozzle units 14 are provided side by side in a zigzag fashion, that is, substantially linearly, in the width direction of the recording sheet 2, that is, in a direction indicated by an arrow W of FIG. 3. Herein, assume that the nozzles 13 are aligned at about 42.3-micron pitch (corresponding to 600 dpi) in each nozzle unit 14. Each of the nozzles 13 has the ink liquid chamber and the heat resistor 11. Hence, by driving the heat resistors 11 individually, it is possible to make ink droplets and wetting liquid droplets w be ejected from the respective nozzles 13.

Regarding a wetting liquid nozzle line 15*w*, a yellow nozzle line 15*y*, a magenta nozzle line 15*m*, a cyan nozzle line 15*c*, and a black nozzle line 15*k* (hereinafter, referred also to simply as the nozzle lines 15) provided side by side substantially linearly, a width in the width direction of the recording sheet 2 (width in the direction indicated by the arrow W of FIG. 3) is formed to match the width size of the recording sheet 2, for example, the A4 size or the A3 size. It should be appreciated that the nozzles 13 are not limited to those provided side by side in a zigzag fashion and the nozzles 13 may be provided side by side in a straight line in the width direction of the recording sheet 2, that is, in the direction indicated by the arrow W of FIG. 3.

Also, on the ejection surface 12, the wetting liquid nozzle line 15*w*, the yellow nozzle line 15*y*, the magenta nozzle line 15*m*, the cyan nozzle line 15*c*, and the black nozzle line 15*k* are provided side by side in this order from upstream to downstream in the transportation direction of the recording sheet 2, that is, in the direction indicated by the arrow A of FIG. 1 and FIG. 2.

Figure 4A:
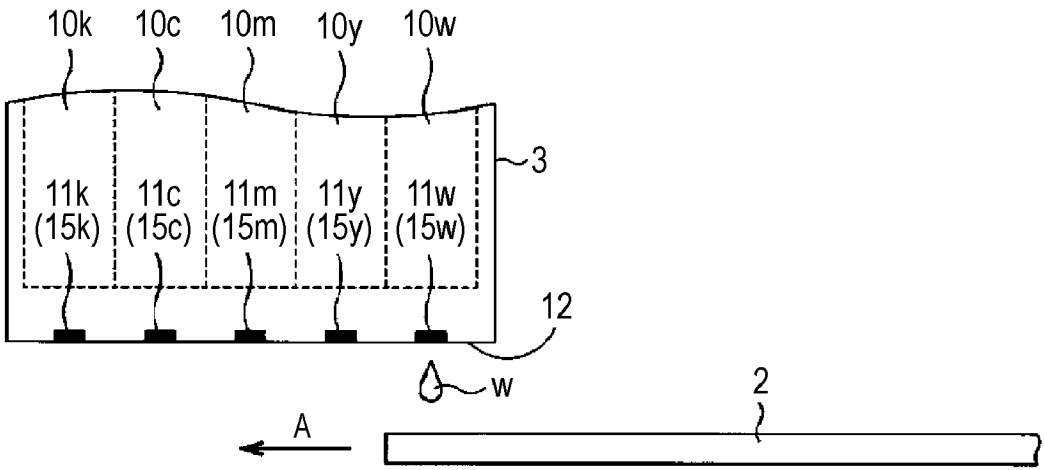
FIG. 4A is a front view showing a state where a wetting liquid droplet is ejected onto a recording sheet.
Figure 4B:
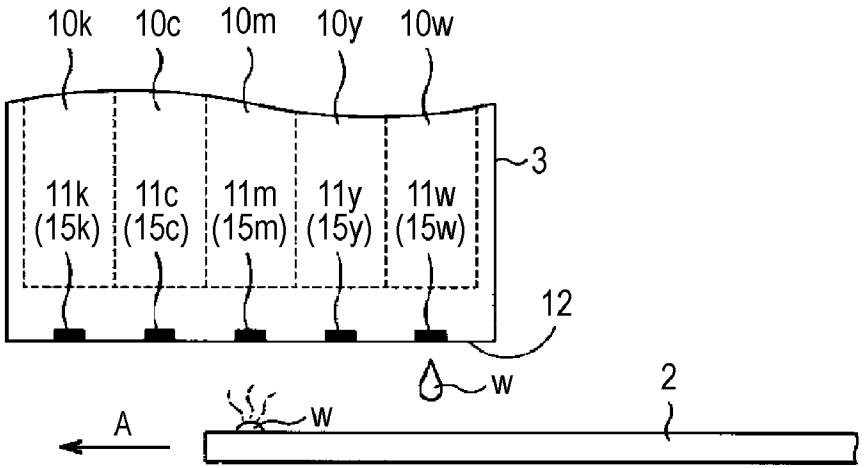
FIG. 4B is a cross section showing a state where nozzle lines and the vicinities thereof are humidified by letting the wetting liquid droplet ejected onto the recording sheet evaporate from the recording sheet.

As is shown in FIG. 4A, the head cartridge 3 having the configuration as above ejects the wetting liquid droplets w from the wetting liquid nozzle line 15*w* provided uppermost stream in the transportation direction of the recording sheet 2 onto the recording sheet 2 transported in a direction indicated by an arrow A of FIG. 4A. Also, as is shown in FIG. 4B, the wetting liquid droplets w ejected onto the recording sheet 2 while the recording sheet 2 is moving evaporate from the recording sheet 2 and humidify the yellow, magenta, cyan, black nozzle lines 15*y*, 15*m*, 15*c*, and 15*k* provided side by side downstream of the wetting liquid nozzle line 15*w* in the transportation direction of the recording sheet 2 and the vicinities thereof.

Meanwhile, the head cartridge 3 ejects ink droplets from the yellow nozzle line 15*y*, the magenta nozzle line 15*m*, the cyan nozzle line 15*c*, and the black nozzle line 15*k* onto the recording sheet 2 and records a print image or the like corresponding to print data on the recording sheet 2.

The magenta nozzle line 15*m* and the vicinity thereof are humidified by the wetting liquid droplets w and they are also humidified when ink droplets are ejected onto the recording sheet 2 from the yellow nozzle line 15*y* provided adjacently upstream in the transportation direction of the recording sheet 2 and the yellow ink droplets ejected onto the recording sheet 2 evaporate from the recording sheet 2.

Also, the cyan nozzle line 15*c* and the vicinity thereof are humidified by the wetting liquid droplets w and they are also humidified when ink droplets are ejected onto the recording sheet 2 from the yellow and magenta nozzle lines 15*y* and 15*m* provided side by side upstream in the transportation direction of the recording sheet 2 and the yellow and magenta ink droplets ejected onto the recording sheet 2 evaporate from the recording sheet 2.

Also, the black nozzle line 15*k* and the vicinity thereof are humidified by the wetting liquid droplets w and they are also humidified when ink droplets are ejected onto the recording sheet 2 from the yellow, magenta, and cyan nozzle lines 15*y*, 15*m*, and 15*c* provided side by side upstream in the transportation direction of the recording sheet 2 and the yellow, magenta, and cyan ink droplets ejected onto the recording sheet 2 evaporate from the recording sheet 2.

In other words, the magenta, cyan, and black nozzle lines 15*m*, 15*c*, and 15*k* provided side by side downstream of the yellow nozzle line 15*y* in the transportation direction of the recording sheet 2 and the vicinities thereof are humidified by the wetting liquid droplets w and also humidified when the ink droplets ejected on the upstream side of the nozzle lines 15*m*, 15*c*, and 15*k* in the transportation direction of the recording sheet 2 evaporate from the recording sheet 2.

The head cartridge 3 having the configuration as above is able to humidify the nozzle lines 15*y*, 15*m*, 15*c*, and 15*k* of the respective colors and the vicinities thereof during the printing, and is thereby able to prevent drying and thickening of the respective inks on the ejection surface 12. The head cartridge 3 thus becomes able to prevent an ejection failure and the curving of an injection direction caused by drying or thickening of the inks during the printing.

In addition, the width of the wetting liquid nozzle line 15*w* is substantially as wide as the widths of the nozzle lines 15*y*, 15*m*, 15*c*, and 15*k* of the respective colors. The head cartridge 3 is therefore able to humidify the nozzles 13 in the nozzle lines 15*y*, 15*m*, 15*c*, and 15*k* of the respective colors from the one on one side to the one on the other side in the width direction of the recording sheet 2. Alternatively, the width of the wetting liquid nozzle line 15*w* may be slightly wider than the widths of the nozzle lines 15*y*, 15*m*, 15*c*, and 15*k* of the respective colors. When configured in this manner, it becomes possible to humidify the nozzles 13 in the nozzle lines 15*y*, 15*m*, 15*c*, and 15*k* of the respective colors from the one on one side to the one on the other side in the width direction of the recording sheet 2 in a more reliable manner than in a case where the wetting liquid nozzle line 15*w* is substantially as wide as the widths of the other nozzle lines 15.

Also, by using a colorless and transparent liquid obtained by removing a dye component or a pigment component from the inks as the wetting liquid, the head cartridge 3 becomes able to control a striking method and an amount of humidification of the wetting liquid droplets w with ease because the wetting liquid can be controlled by each nozzle 13 as with the inks.

Figure 5:
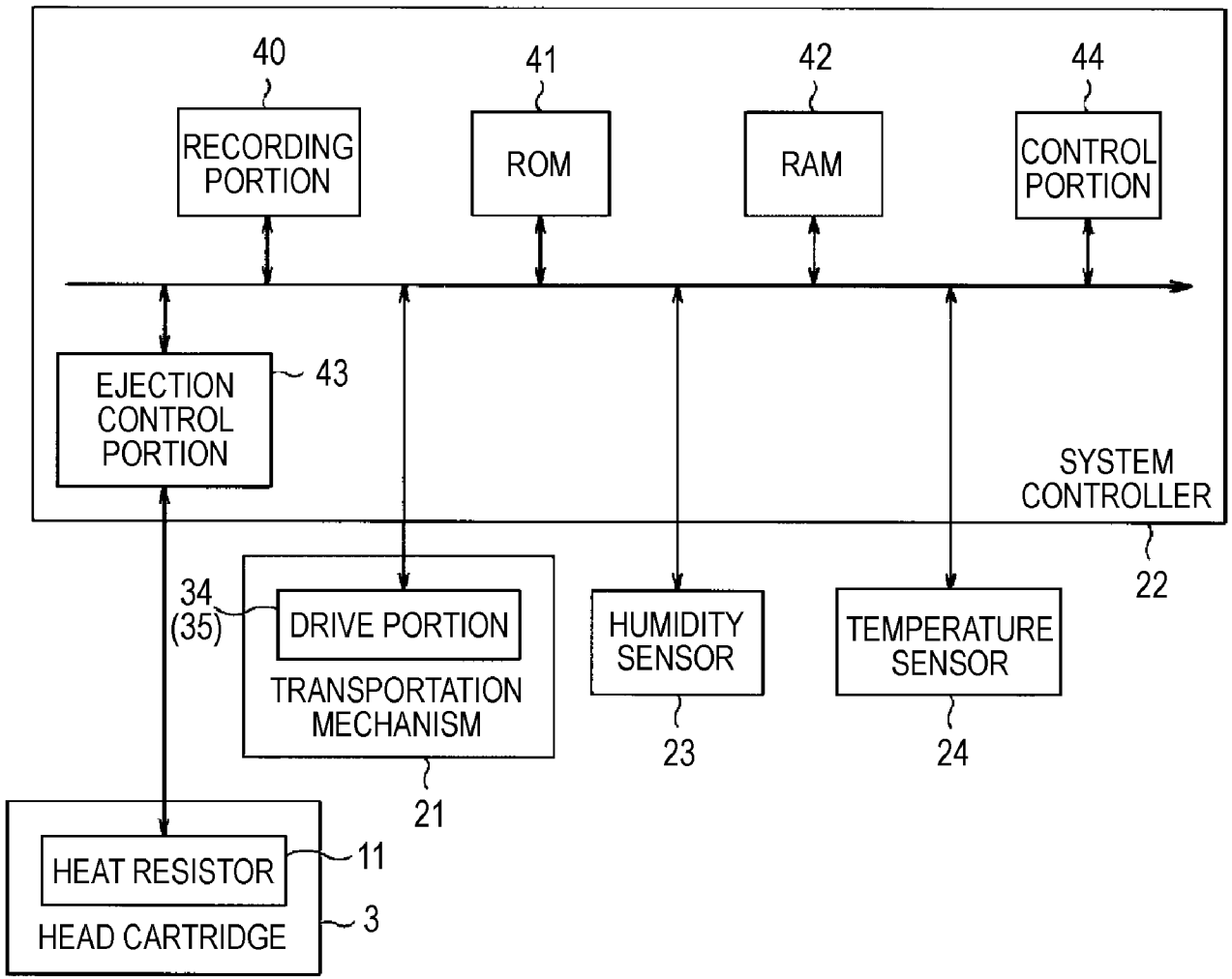
FIG. 5 is a block diagram of a system controller.

As are shown in FIG. 2 and FIG. 5, the device main body 4 to which the head cartridge 3 is attached includes a platen plate 20 that supports the recording sheet 2 transported to a position opposing the ejection surface 12 of the head cartridge 3 with a predetermined interval, a transportation mechanism 21 that transports the recording sheet 2 to the ejection surface 12, a system controller 22 that controls an overall operation, a humidity sensor 23 that measures a humidity, and a temperature sensor 24 that measures a temperature.

The platen plate 20 is provided oppositely to be parallel to the ejection surface 12 of the head cartridge 3 with a predetermined distance at the printing position of the recording sheet 2. The platen plate 20 guides the recording sheet 2 transported to the printing position to a paper discharge roller 32 and a spur 33 from a feed roller 30 and a pinch roller 31 in the transportation mechanism 21 described below.

The transportation mechanism 21 includes the feed roller 30 and the pinch roller 31 that transport the recording sheet 2 transported from an unillustrated paper feed roller that transports the recording sheet 2 stored in an unillustrated storage tray of the device main body 4 into a space between the head cartridge 3 and the platen plate 20, and the paper discharge roller 32 and the spur 33 that transport the printed recording sheet 2 to an unillustrated paper discharge port of the device main body 4. The feed roller 30 and the pinch roller 31 are provided upstream in reference to the head cartridge 3 in the transportation direction of the recording sheet 2 and the paper discharge roller 32 and the spur 33 are provided downstream in reference to the head cartridge 3 in the transportation direction of the recording sheet 2.

The transportation mechanism 21 pinches the recording sheet 2 transported from the unillustrated paper feed roller that transports the recording sheet 2 stored in the unillustrated storage tray of the device main body 4 between the feed roller 30 and the pinch roller 31. The transportation mechanism 21 then transports the recording sheet 2 into a space between the head cartridge 3 and the platen plate 20, for example, by driving the feed roller 30 to rotate about the shaft in a direction indicated by an arrow B of FIG. 2 using a drive portion 34, such as a drive motor.

The transportation mechanism 21 also pinches the recording sheet 2 printed by the head cartridge 3 between the paper discharge roller 32 and the spur 33. The transportation mechanism 21 then discharges the recording sheet 2 from the unillustrated paper discharge port of the device main body 4, for example, by driving the paper discharge roller 32 about the shaft in a direction indicated by an arrow B of FIG. 2 using a drive portion 35, such as a drive motor.

As is shown in FIG. 5, the system controller 22 includes a recording portion 40 that temporarily stores print data to be printed, a ROM (Read Only Memory) 41 that stores a control program to control an overall operation, a RAM (Random Access Memory) 42 that is used to temporarily load the control program stored in the ROM 41, an ejection control portion 43 that controls the heat resistors 11, and a control portion 44 that controls an overall operation.

The recording portion 40 is a memory that temporarily stores print data inputted, for example, from an external information processing device. The ROM 41 is formed of an EP-ROM (Erasable Programmable Read-Only Memory) or the like and stores a control program that controls an overall operation. The RAM 42 is used to temporarily load the control program stored in the ROM 41 according to the print data.

The control portion 44 is formed of a CPU (Central Processing Unit) and controls an overall operation according to the control program loaded in the RAM 42 from the ROM 41 and the print data inputted from an external information processing device or the like. For example, when the print data is inputted into the system controller 22 from an external information processing device, the control portion 44 outputs the print data and a humidification drive signal that drives a humidification control portion 50 described below to the ejection control portion 43.

Figure 6:
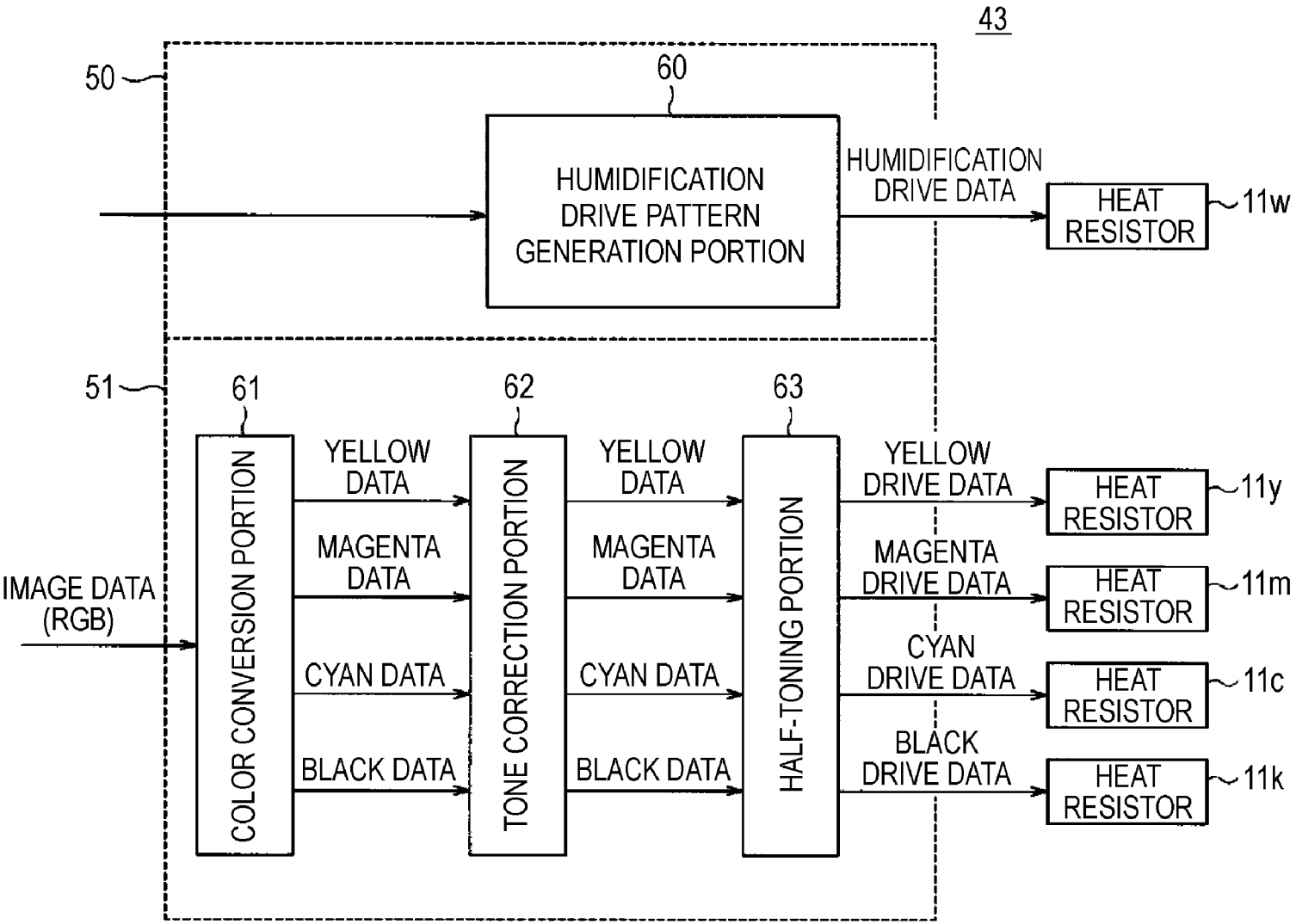
FIG. 6 is a block diagram of en ejection control portion.

As is shown in FIG. 6, the ejection control portion 43 is formed of the humidification control portion 50 that controls the wetting liquid heat resistors 11*w* and an ink control portion 51 that controls the heat resistors 11*y*, 11*m*, 11*c*, and 11*k* of the respective colors according to the print data to be printed.

The humidification control portion 50 has a humidification drive pattern generation portion 60. When the humidification drive signal is inputted into the humidification drive pattern generation portion 60 from the control portion 44, the humidification control portion 50 generates humidification drive data that drives the wetting liquid heat resistors 11*w* using the humidification drive pattern generation portion 60. The humidification control portion 50 then outputs the humidification drive data generated by the humidification drive pattern generation portion 60 to the wetting liquid heat resistors 11*w* and drives the heat resistors 11*w*.

Upon input of the print data from the control portion 44, the ink control portion 51 converts the print data to color data of four colors corresponding to the ink colors, that is, yellow, magenta, cyan, and black, using a color conversion portion 61.

The ink control portion 51 then applies a tone correction on the color data converted by the color conversion portion 61 using a tone correction portion 62. The ink control portion subsequently converts the color data after the tone correction by the tone correction portion 62 to ink drive data that drives the heat resistors 11*y*, 11*m*, 11*c*, and 11*k* of the respective colors using a half-toning portion 63. The ink control portion 51 then output the ink drive data converted by the half-toning portion 63 to the corresponding heat resistors 11*y*, 11*m*, 11*c*, and 11*k* and drives the heat resistors 11*y*, 11*m*, 11*c*, and 11*k* in order of yellow, magenta, cyan, and black.

At least one humidity sensor 23 is provided, for example, inside the device main body 4. It measures the humidity on the periphery of the printer device 1 and outputs humidity measurement data to the system controller 22. At least one temperature sensor 24 is provided, for example, inside the device main body 4. It measures the temperature on the periphery of the printer device 1 and outputs temperature measurement data to the system controller 22. It should be appreciated, however, that the humidity sensor 23 and the temperature sensor 24 are not limited to those provided inside the device main body 4 and each can be provided at any position inside the printer device 1. For example, they may be provided inside the head cartridge 3. In addition, the humidity sensor 23 and the temperature sensor 24 are not limited to those used to measure the humidity and the temperature on the periphery of the printer device 1. They may be provided inside the device main body 4 or inside the head cartridge 3 so as to measure the humidity and the temperature relating to the printer device 1, such as the humidity and the temperature inside the printer device 1, the humidity and the temperature of the ejection surface 12, the head cartridge 3, the device main body 4, the inks, or the wetting liquid.

Figure 7:
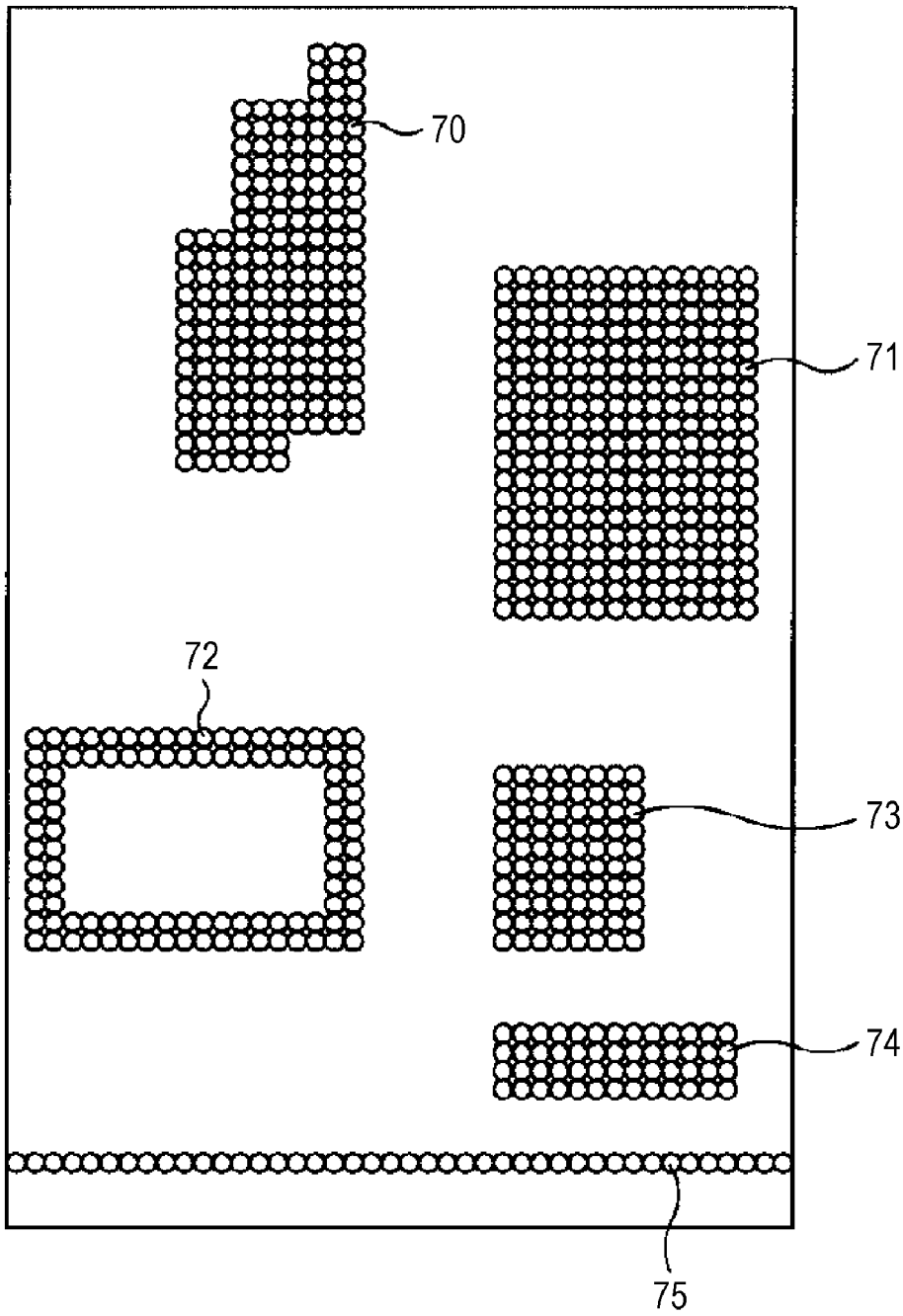
FIG. 7 is a view showing an example of a print image.

Hereinafter, a method of humidifying the nozzle lines 15*y*, 15*m*, 15*c*, and 15*k* of the respective colors and the vicinities thereof by ejecting the wetting liquid droplets w onto the recording sheet 2 during the printing without interrupting the printing by the printer device 1 will be described. Descriptions will be given to a case where the printer device 1 includes first through sixth print regions 70, 71, 72, 73, 74, and 75 as shown in FIG. 7 and prints a print image having a resolution (density) of 600 dpi (dots per inch).

The control portion 44 removes an unillustrated head cap from the ejection surface 12 of the head cartridge 3 according to print data inputted from an external information processing device and makes tens to hundreds of ink droplets be ejected onto an unillustrated ink receiver to ensure that inks are ejected from all the nozzles 13. Also, the control portion pinches the recording sheet 2 transported from the unillustrated paper feed roller that transports the recording sheet 2 stored in the unillustrated storage tray of the device main body 4 using the feed roller 30 and the pinch roller 31, and transports the recording sheet 2 into a space between the head cartridge 3 and the platen plate 20, for example, by driving the feed roller 30 to rotate about the shaft in the direction indicated by the arrow B of FIG. 2 using the drive portion 34, such as a drive motor.

Meanwhile, the ink control portion 51 converts the print data inputted from the control portion 44 into color data of four colors corresponding to the ink colors, that is, yellow, magenta, cyan, and black, using the color conversion portion 61. The ink control portion 51 then applies a tone correction on the color data converted by the color conversion portion 61 using the tone correction portion 62. The ink control portion 51 subsequently converts the color data after the tone correction by the tone correction portion 62 to ink drive data that drives the heat resistors 11*y*, 11*m*, 11*c*, and 11*k* of the respective colors using the half-toning portion 63.

Figure 8B:
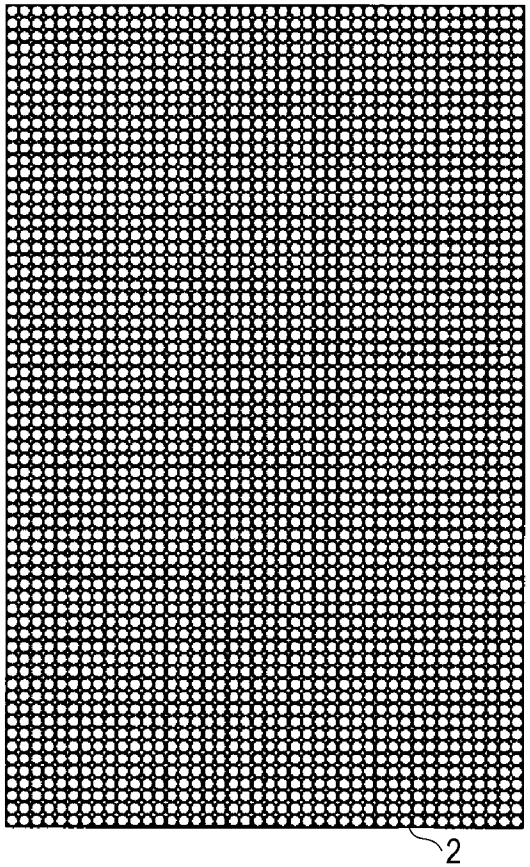
FIG. 8A is a view showing humidification drive data to eject one wetting liquid droplet at a time constantly at the density of 300 dpi and FIG. 8B is a view showing humidification drive data to eject one wetting liquid droplet at a time constantly at the density of 600 dpi.
Figure 8A:
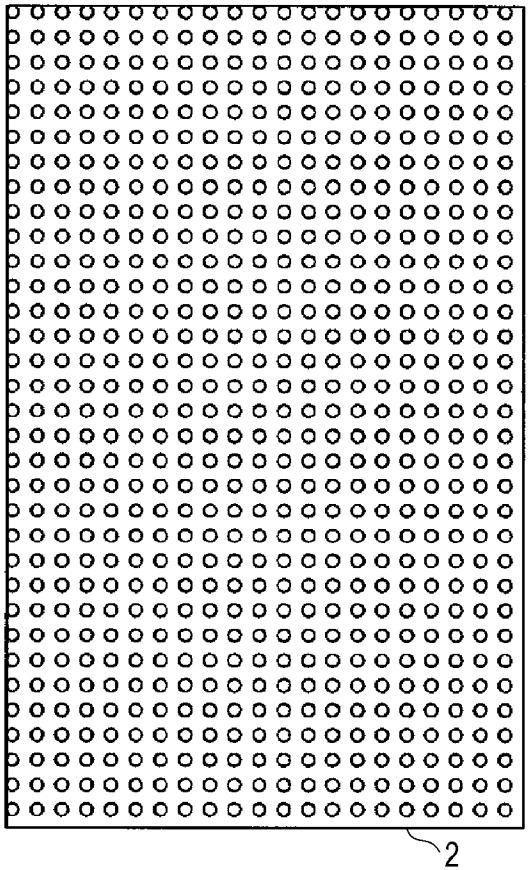

Also, when the humidification drive signal is inputted into the humidification drive pattern generation portion 60 from the control portion 44, the humidification control portion 50 generates the humidification drive data that drives the wetting liquid heat resistors 11*w* using the humidification drive pattern generation portion 60. To be more concrete, as is shown in FIG. 8A, the humidification portion 50 generates humidification drive data to eject one wetting liquid droplet w at a time at the density of 300 dpi independently of the content of a print image.

The recording sheet 2 is then transported into a space between the head cartridge 3 and the platen plate 20. Upon receipt of a print start signal, the humidification control portion 50 applies a current to the heat resistors 11*w* in synchronization with a print timing signal to heat the wetting liquid supplied from the wetting liquid ink cartridge 10*w* for air bubbles to be generated, so that, as is shown in FIG. 4A, the wetting liquid droplets w are ejected from the nozzle line 15*w* onto the recording sheet 2 transported in a space between the head cartridge 3 and the platen plate 20 one droplet at a time constantly at the density, for example, of 300 dpi independently of the content of a print image as is shown in FIG. 8A.

Meanwhile, the ink control portion 51 outputs the ink drive data corresponding to the print position to the heat resistors 11*y*, 11*m*, 11*c*, and 11*k* of the respective colors and drives the heat resistors 11*y*, 11*m*, 11*c*, and 11*k*. In this instance, the ink droplets are not ejected from some of the ejection portions for a while during the printing depending on the print data. At these ejection portions, the inks on the ejection surface 12 normally evaporate to dry or thicken. According to the embodiment of the present invention, however, because the wetting liquid landed on the recording sheet 2 evaporates and humidifies also the ejection portions that have not ejected ink droplets, it becomes possible to prevent drying and thickening.

The control portion 44 drives the drive portions 34 and 35, such as drive motors, in the transportation mechanism 21 to move the recording sheet 2 while executing the printing. When the printing ends, the control portion 44 discharges the printed recording sheet 2 from the unillustrated paper discharge port of the device main body 4 using the transportation mechanism 21.

It should be appreciated that the control portion 44 is not limited to a type that performs the control so that the wetting liquid droplets w are ejected onto the recording sheet 2 one droplet at a time constantly at the density of 300 dpi and it is sufficient to eject the wetting liquid droplets w in a constant amount of humidification independently of the content of a print image. As is shown in FIG. 8B, the control portion 44 may execute control in such a manner that one wetting liquid droplet w is ejected at a time constantly at the density, for example, of 600 dpi. In this manner, the resolution (density) at which the wetting liquid droplets w are ejected can be changed as the necessity arises.

The printer device 1 having the configuration as above ejects the wetting liquid droplets w from the entire range of the nozzle line 15*w* at a constant amount of humidification independently of the content of a print image onto the recording sheet 2 transported into a space between the head cartridge 3 and the platen plate 20 by the transportation mechanism 21. Because the wetting liquid droplets w ejected onto the recording sheet 2 evaporate from the recording sheet 2, the printer device 1 becomes able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and the vicinities thereof during the printing across the entire range at a constant amount of humidification.

Hence, the printer device 1 is able to prevent drying and thickening of the respective inks on the ejection surface 12 during the printing. The head cartridge 3 thus becomes able to prevent an ejection failure and the curving of an ejection direction caused by drying or thickening of the inks during the printing.

Figure 9:
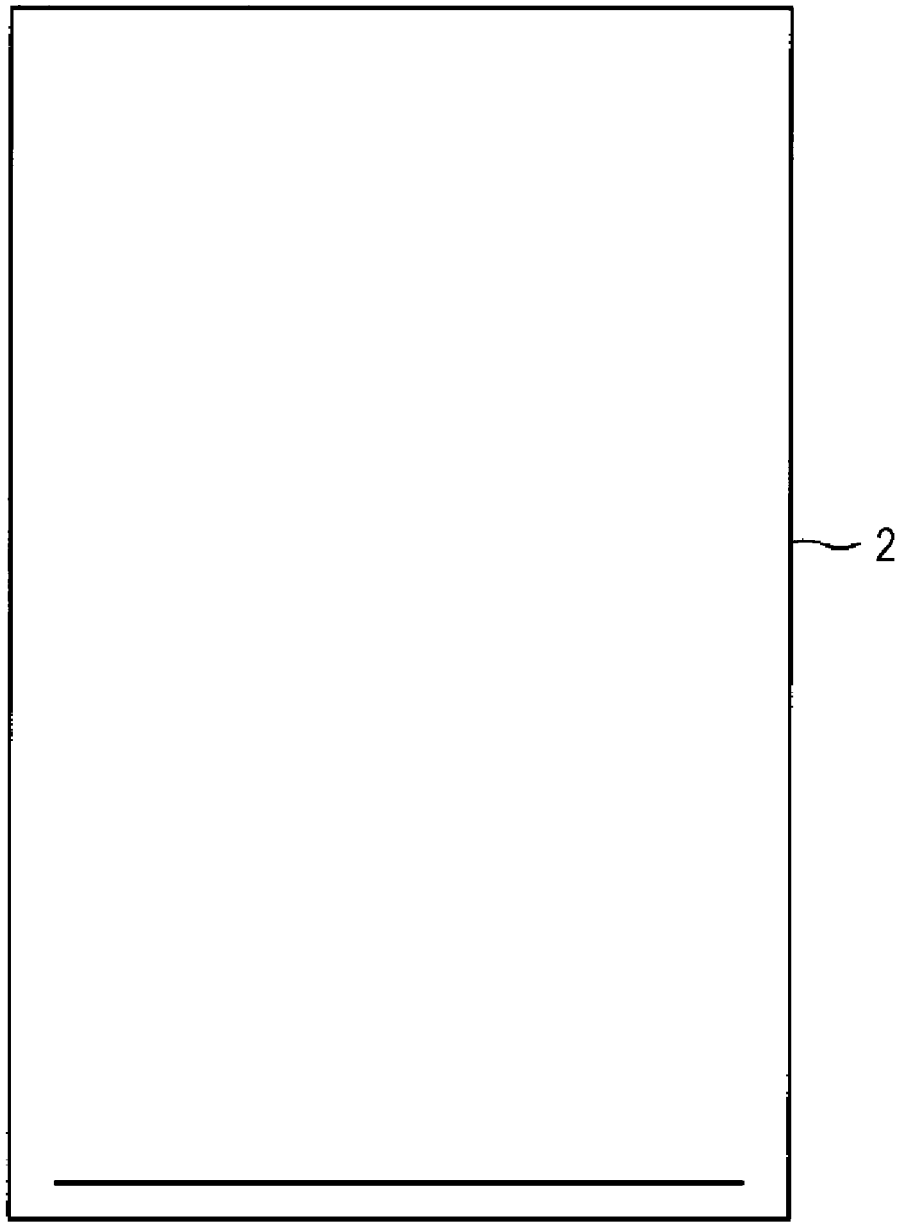
FIG. 9 is a view showing another example of a print image.

Accordingly, even in a case where there are nozzles 13 that do not eject ink from the nozzle lines 15 during the printing until the end of the printing, for example, in a case where one line is printed in the width direction of the recording sheet 2 at the end of the printing as is shown in FIG. 9, the printer device 1 is able to humidify such nozzles 13 during the printing by performing humidification across the entire range at a constant amount of humidification independently of the content of a print image. It thus becomes possible to prevent an ejection failure and the curving of an ejection direction caused by drying or thickening of the ink.

Also, the width of the wetting liquid nozzle line 15*w* is provided substantially as wide as the widths of the nozzle lines 15*y*, 15*m*, 15*c*, and 15*k* of the respective colors. The printer device 1 is therefore able to humidify the nozzles 13 in the nozzle lines 15*y*, 15*m*, 15*c*, and 15*k* of the respective colors from the one on one side to the one on the other side in the width direction of the recording sheet 2 in a reliable manner.

Also, by using a colorless and transparent liquid obtained by removing the dye component or the pigment component from the inks as the wetting liquid, the printer device 1 becomes able to control the striking method and an amount of humidification of the wetting liquid droplets w with ease because the wetting liquid can be controlled by each nozzle 13 as with the inks.

It should be appreciated that the printer device 1 is not limited to a type that ejects the wetting liquid droplets w at a constant amount of humidification across the entire range of the recording sheet 2 during the printing independently of the content of a print image. The printer device 1 may be configured in such a manner that an amount of humidification of the wetting liquid droplets w is varied with the humidity and the temperature relating to the printer device 1, such as the humidity and the temperature on the periphery of the printer device 1 or inside the printer device 1, the humidity and the temperature of the ejection surface 12, the head cartridge 3, the device main body 4, the ink, or the wetting liquid.

Hereinafter, a printer device 1*a* configured to eject the wetting liquid droplets w onto the recording sheet 2 by varying an amount of humidification of the wetting liquid droplets w with the humidity and the temperature on the periphery of the printer device 1 will be described. It should be appreciated that the humidity and the temperature are not limited to those on the periphery of the printer device 1 and can be any of the humidity and the temperature described above. Also, because the printer device 1*a* has the same configuration as the printer device 1 described above, descriptions are omitted by labeling the same components with the same reference numerals.

More specifically, according to the humidification method of the printer device 1 described above, upon input of the print data from an external information processing device, the control portion 44 outputs the humidity measurement data of the humidity on the periphery of the printer device 1 measured by the humidity sensor 23 provided inside the device main body 4 to the humidity control portion 50. Also, the control portion 44 outputs the temperature measurement data of the temperature on the periphery of the printer device 1 measured by the temperature sensor 24 provided inside the device main body 4 to the humidification control portion 50. Further, the control portion 44 outputs the humidification drive signal to the humidification control portion 50.

Figure 10:
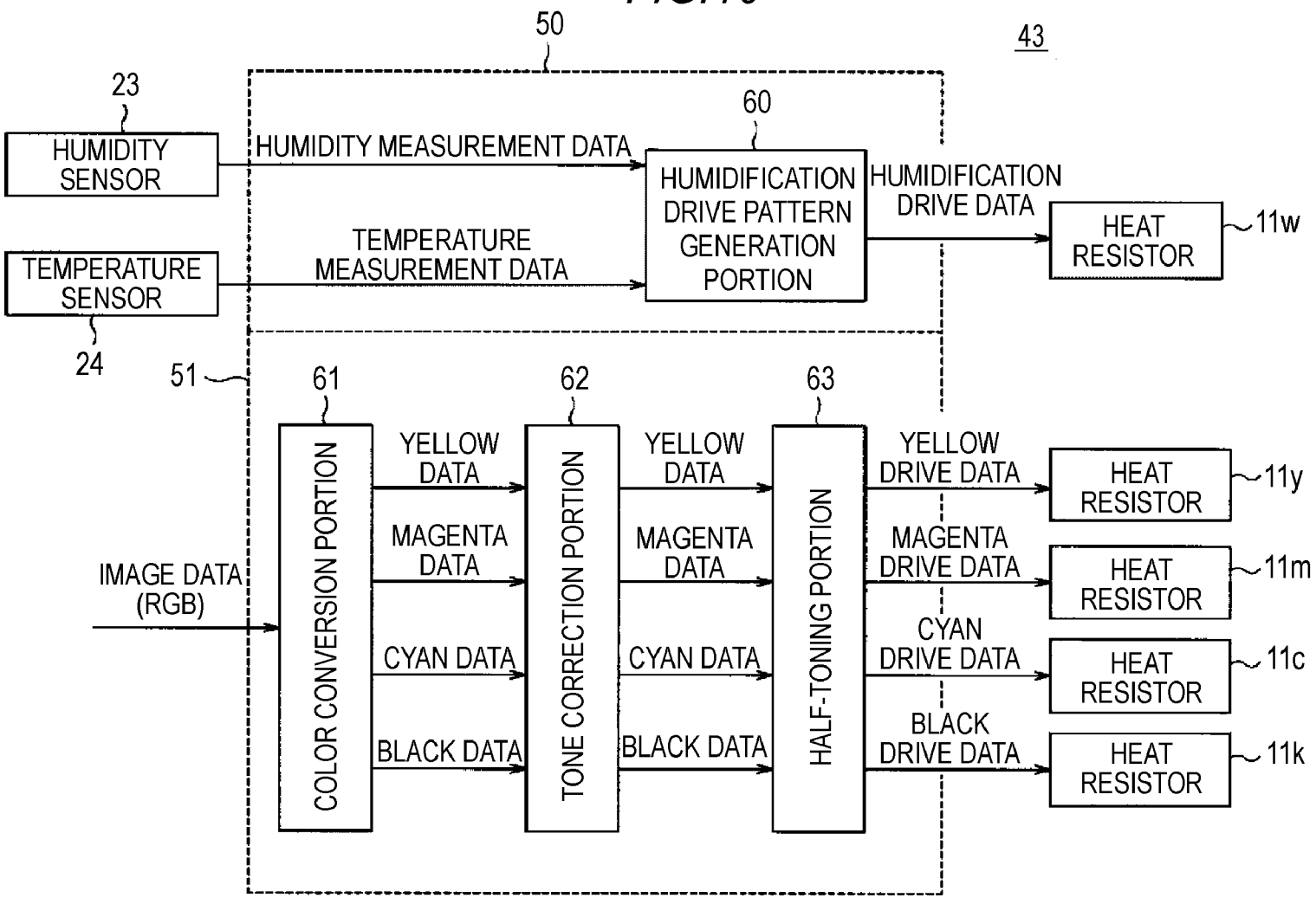
FIG. 10 is a block diagram of the ejection control portion when ejection liquid droplets are ejected by varying an amount thereof with humidity measurement data and temperature measurement data.

Subsequently, as is shown in FIG. 10, the humidification control portion 50 generates the humidification drive data that drives the wetting liquid heat resistors 11*w* using the humidification drive pattern generation portion 60 according to the humidity measurement data and the temperature measurement data.

For example, when the humidity on the periphery of the printer device 1*a* is lower than a preliminarily set threshold value, the humidification control portion 50 generates humidification drive data to increase an amount of humidification of the wetting liquid droplets w by increasing the resolution (density) at which the wetting liquid droplets w are ejected. Also, when the humidity on the periphery of the printer device 1*a* is higher than the preliminarily set threshold value, the humidification control portion 50 generates humidification drive data to reduce an amount of humidification of the wetting liquid droplets w by decreasing the resolution (density) at which the wetting liquid droplets w are ejected.

Also, when the temperature on the periphery of the printer device 1*a* is higher than a preliminarily set threshold value, the humidification control portion 50 generates humidification drive data to increase an amount of humidification of the wetting liquid droplets w by setting a higher resolution (density) at which the wetting liquid droplets w are eject. When the temperature on the periphery of the printer device 1*a* is lower than the preliminarily set threshold value, because drying and thickening hardly occur during the printing, the humidification control portion 50 generates humidification drive data to reduce an amount of humidification of the wetting liquid droplets w by decreasing the resolution (density) at which the wetting liquid droplets w are ejected.

To be more concrete, when the temperature and the humidity on the periphery of the printer device 1*a* are 20 degrees to 25 degrees and 40% to 60%, respectively, that is, when the humidity is lower than the preliminarily set threshold value, the humidification control portion 50 generates humidification drive data to eject one wetting liquid droplet w at a time at the density, for example, of 300 dpi independently of the content of a print image. On the contrary, when the temperature and the humidity on the periphery of the printer device 1*a* are 20 degrees to 25 degrees and 600 or higher, respectively, that is, when the humidity is higher than the preliminarily set threshold value, the humidity control portion 50 generates humidity drive data to eject one wetting liquid droplet w at a time at the density, for example, of 200 dpi independently of the content of a print image.

The humidification control portion 50 then outputs the humidification drive data generated by the humidification drive pattern generation portion 60 to the wetting liquid heat resistors 11*w* and drives the wetting liquid heat resistors 11*w*.

The humidification control portion 50 may be configured in such a manner that an amount of humidification of the wetting liquid droplets w is varied by varying the number of ejection times of the wetting liquid droplets w according to the humidity and the temperature of the printer device 1*a*. For example, when the humidity of the printer device 1*a* is lower than the preliminarily set threshold value, the humidification control portion 50 may generate humidification drive data to increase an amount of humidification of the wetting liquid droplets w by ejecting the wetting liquid droplets w twice. Also, when the humidity of the printer device 1*a* is higher than the preliminarily set threshold value, because drying and thickening hardly occur during the printing, the humidification control portion 50 may generate humidification control data to reduce an amount of humidification of the wetting liquid droplets w by ejecting the wetting liquid droplets w once.

When the temperature of the printer device 1*a* is higher than the preliminarily set threshold value, the humidification control portion 50 may generate humidification control data to increase an amount of humidification of the wetting liquid droplets w by ejecting the wetting liquid droplets w twice. Also, when the temperature of the printer device 1*a* is lower than the preliminarily set threshold value, because drying and thickening hardly occur during the printing, the humidification control portion 50 may generate humidification drive data to reduce an amount of humidification of the wetting liquid droplets w by ejecting the wetting liquid droplets w once.

To be more concrete, when the temperature and the humidity on the periphery of the printer device 1*a* are 10 degrees to 20 degrees and 300 or below, respectively, that is, when the humidity is lower than the preliminarily set threshold value, the humidification control portion 50 generates humidification drive data to eject two wetting liquid droplets w at a time at the density of 600 dpi independently of the content of a print image. On the contrary, when the temperature and the humidity on the periphery of the printer device 1*a* are 10 degrees to 20 degrees and 30% to 40%, respectively, that is, when the humidity is higher than the preliminarily set threshold value, the humidification control portion 50 generates humidification drive data to eject one wetting liquid droplet w at a time at the density of 600 dpi independently of the content of a print image.

The printer device 1*a* having the configuration as above ejects the wetting liquid droplets w onto the recording sheet 2 transported into a space between the head cartridge 3 and the platen plate 20 by the transportation mechanism 21 across the entire range of the nozzle line 15*w* at a constant amount of humidification that best suits the temperature and the humidity on the periphery of the printer device 1*a* independently of the content of a print image. Because the wetting liquid droplets w ejected onto the recording sheet 2 evaporate from the recording sheet 2, the printer device 1*a* is able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and vicinities thereof across the entire range at a constant amount of humidification that best suits the temperature and the humidity on the periphery of the printer device 1*a* during the printing.

The printer device 1*a* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by performing humidification at a constant amount of humidification that best suits the temperature and the humidity, the printer device 1*a* becomes able to reduce an amount of the used wetting liquid and energy necessary to eject the wetting liquid. Also, in a case where the humidity is high or the temperature is low, the printer device 1*a* is able to prevent smearing and overflow of the inks by reducing an amount of the wetting liquid. Humidification is thus performed effectively.

The printer device 1 may be configured in such a manner that an amount of the wetting liquid droplets w is varied with two types of recording sheets 2: photographic glossy paper or paper specialized for ink jet printing and copy paper. To be more concrete, an amount of the wetting liquid droplets w may be varied with an allowable amount of droplets per unit area acceptable by the ink droplets and the wetting liquid droplets w corresponding to the type of the recording sheet 2.

Hereinafter, a printer device 1*b* configured to eject the wetting liquid droplets w onto the recording sheet 2 by varying an amount of humidification of the wetting liquid droplets w with an allowable amount of droplets per unit area acceptable by the ink droplets and the wetting liquid droplets w corresponding to the type of the recording sheet 2 will be described. Because the printer device 1*b* has the same configuration as the printer device 1 described above, descriptions are omitted by labeling the same components with the same reference numerals.

More specifically, according to the humidification method of the printer device 1 described above, upon input of print data from an external information processing device, the control portion 44 detects the type of the recording sheet 2 on which a print image is to be printed by the inputted print data. The control portion 44 then reads out allowable droplet amount data specifying an allowable amount of droplets per unit area acceptable by the ink droplets and the wetting liquid droplets w of the recording sheet 2 on the basis of the detected type of the recording sheet 2, for example, from the recording portion 40 and outputs the allowable droplet amount data to the humidification control portion 50.

Figure 11:
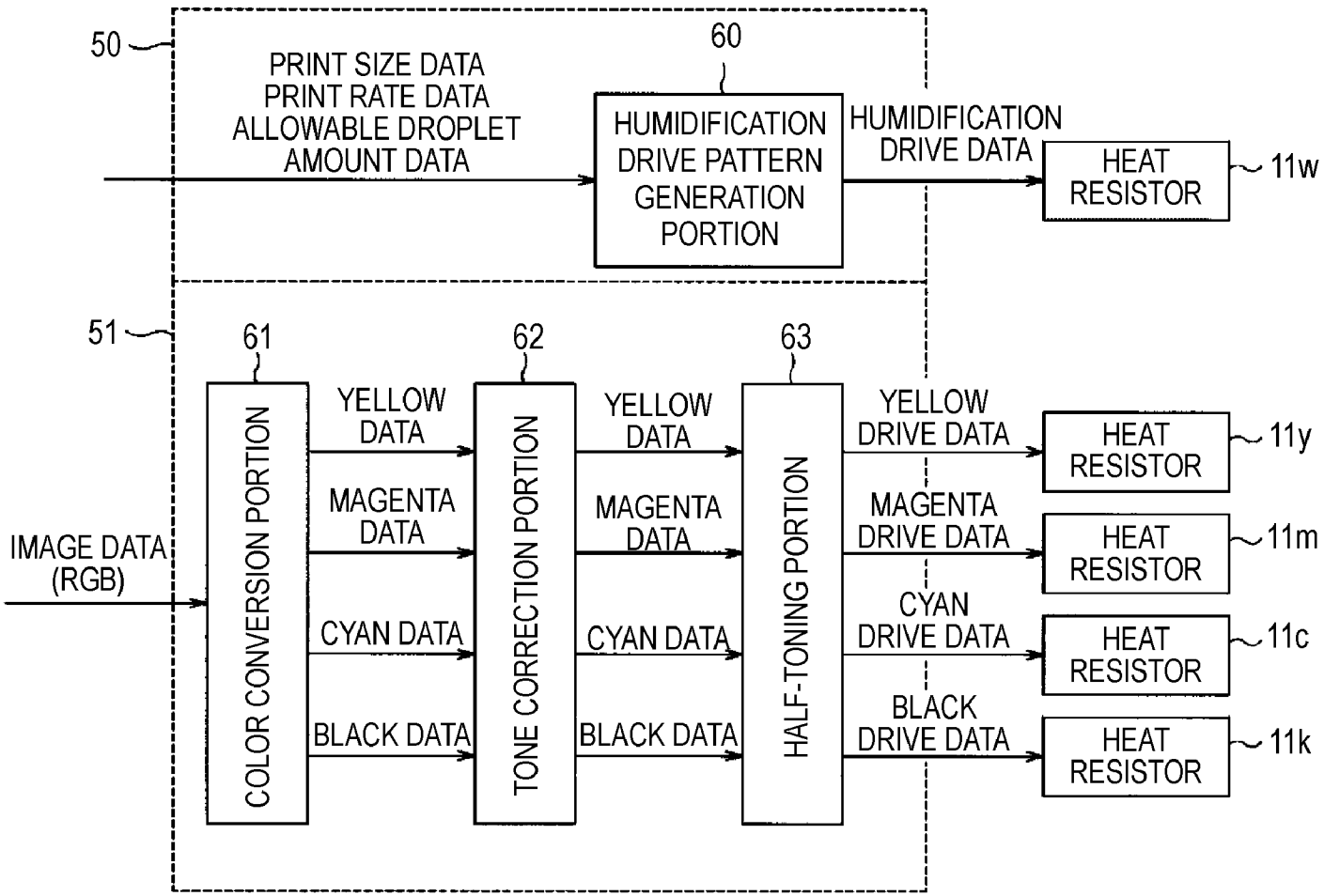
FIG. 11 is a block diagram of the ejection control portion when wetting liquid droplets are ejected by varying an amount thereof with an allowable amount of droplets of the recording sheet, a print rate, and the size or the number of recording sheets.

As is shown in FIG. 11, the humidification control portion 50 then generates humidification drive data that drives the wetting liquid heat resistors 11*w* using the humidification drive pattern generation portion 60 according to the allowable droplet amount data of the recording sheet 2 inputted therein from the control portion 44.

For example, in the case of the recording sheet 2 having an allowable amount of droplets per unit area acceptable by the ink droplets and the wetting liquid droplets w larger than a preliminarily set threshold value, the humidification control portion 50 generates humidification drive data to increase an amount of humidification of the wetting liquid droplets w by increasing the resolution (density) at which the wetting liquid droplets w are ejected. Also, in the case of the recording sheet 2 having an allowable amount of droplets per unit area smaller than the preliminarily set threshold value, in order to prevent smearing and overflow of the inks, the humidification control portion 50 generates humidification control data to reduce an amount of humidification of the wetting liquid droplets w by decreasing the resolution (density) at which the wetting liquid droplets w are ejected.

To be more concrete, in the case of the recording sheet 2 having an allowable amount of droplets per unit area acceptable by the ink droplets and the wetting liquid droplets w larger than the preliminarily set threshold value, such as photographic glossy paper and paper specialized for ink jet printing, the humidification control portion 50 generates humidification drive data to eject one wetting liquid droplet w at a time at the density of 600 dpi independently of the content of a print image. On the contrary, in the case of the recording sheet 2 having an allowable amount of droplets per unit area smaller than the preliminarily set threshold value, such as copy paper, the humidification control portion 50 generates humidification drive data to eject one wetting liquid droplet w at a time at the density of 200 dpi independently of the content of a print image.

The humidification control portion 50 then outputs the humidification drive data generated by the humidification drive pattern generation portion 60 to the wetting liquid heat resistors 11*w* and drives the wetting liquid heat resistors 11*w*. The humidification control portion 50 may be configured in such a manner that an amount of humidification of the wetting liquid droplets w is varied by varying the number of ejection times of the wetting liquid droplets w with an allowable amount of droplets per unit area acceptable by the ink droplets and the wetting liquid droplets w of the recording sheets 2.

The printer device 1*b* having the configuration as above ejects the wetting liquid droplets w onto the recording sheet 2 transported into a space between the head cartridge 3 and the platen plate 20 by the transportation mechanism 21 across the entire range of the nozzle line 15*w* at a constant amount of humidification that best suits the type of the recording sheet 2, to be more specific, an allowable amount of droplets per unit area acceptable by the ink droplets and the wetting liquid droplets w of the recording sheet 2, independently of the content of a print image. Because the wetting liquid droplets w ejected onto the recording sheet 2 evaporate from the recording sheet 2, the printer device 1*b* is able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and the vicinities thereof across the entire range at a constant amount of humidification that best suits an allowable amount of droplets per unit area acceptable by the ink droplets and the wetting liquid droplets w of the recording sheet 2 during the printing.

The printer device 1*b* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by performing humidification at a constant amount of humidification that best suits an allowable amount of droplets per unit area of the recording sheet 2, the printer device 1*b* is able to reduce an amount of the used wetting liquid and energy necessary to eject the wetting liquid. Also, the printer device 1*b* is able to prevent smearing and overflow of the inks even when a print image is printed on the recording sheet 2 having a small allowable amount of droplets. Humidification is thus performed effectively.

Alternatively, an amount of the wetting liquid droplets w may be varied with a print rate.

Hereinafter, a printer device 1*c* configured to eject the wetting liquid droplets w onto the recording sheet 2 by varying an amount of humidification of the wetting liquid droplets w with a print rate will be described. Because the printer device 1*c* has the same configuration as the printer device 1 described above, descriptions are omitted by labeling the same components with the same reference numerals.

More specifically, according to the humidification method of the printer device 1 described above, upon input of the print data from an external information processing device, the control portion 44 detects a print rate at which a print image is to be printed by the inputted print data. The control portion 44 then outputs print rate data specifying the detected print rate to the humidification control portion 50.

As is shown in FIG. 11, the humidification control portion 50 generates humidification drive data that drives the wetting liquid heat resistors 11*w* using the humidification drive pattern generation portion 60 according to the print rate data inputted therein from the control portion 44.

For example, when the print rate is slower than a preliminarily set threshold value, the humidification control portion 50 generates humidification drive data to increase an amount of humidification of the wetting liquid droplets w by increasing the resolution (density) at which the wetting liquid droplets w are ejected. When the print rate is higher than the preliminarily set threshold value, because drying and thickening hardly occur during the printing, the humidification control portion 50 generates humidification drive data to reduce an amount of humidification of the wetting liquid droplets w by decreasing the resolution (density) at which the wetting liquid droplets w are ejected.

To be more concrete, when the print rate is slower than the preliminarily set threshold value, the humidification control portion 50 generates humidification drive data to eject one wetting liquid droplet w at a time at the density of 600 dpi independently of the content of a print image. On the contrary, when the print rate is higher than the preliminarily set threshold value, the humidification control portion 50 generates humidification drive data to eject one wetting liquid droplet w at a time at a density of 200 dpi independently of the content of a print image.

The humidification control portion 50 then outputs the humidification drive data generated by the humidification drive pattern generation portion 60 to the wetting liquid heat resistors 11*w* and drives the wetting liquid heat resistors 11*w*. The humidification control portion 50 may be configured in such a manner that an amount of humidification of the wetting liquid droplets w is varied by varying the number of ejection times of the wetting liquid droplets w with the print rate.

The printer device 1*c* having the configuration as above ejects the wetting liquid droplets w onto the recording sheet 2 transported into a space between the head cartridge 3 and the platen plate 20 by the transportation mechanism 21 across the entire range of the nozzle line 15*w* at a constant amount of humidification that best suits the type of the recording sheet 2, to be more specific, the print rate, independently of the content of a print image. Because the wetting liquid droplets w ejected onto the recording sheet 2 evaporate from the recording sheet 2, the printer device 1*c* is able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and the vicinities thereof across the entire range at a constant amount of humidification that best suits the print rate during the printing.

The printer device 1*c* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by performing humidification at a constant amount of humidification that best suits the print rate, the printer device 1*c* is able to reduce an amount of the used wetting liquid and energy necessary to eject the wetting liquid. Also, the printer device 1*c* is able to prevent smearing and overflow of the inks even when the print rate is slow. Humidification is thus performed effectively.

Alternatively, an amount of the wetting liquid droplets w may be varied with the size of the recording sheet 2 or the number of sheets to be printed continuously.

Hereinafter, a printer device 1*d* configured to eject the wetting liquid droplets w onto the recording sheet 2 by varying an amount of humidification of the wetting liquid droplets w with the size of the recording sheet 2 or the number of sheets to be printed continuously will be described. Because the printer device 1*d* has the same configuration as the printer device 1 described above, descriptions are omitted by labeling the same components with the same reference numerals.

More specifically, according to the humidification method of the printer device 1 described above, upon input of the print data from an external information processing device, the control portion 44 outputs recording sheet size data specifying the size of the recording sheet 2 on which a print image is to be printed by the input print data and the number of sheets to be printed to the humidification control portion 50.

As is shown in FIG. 11, the humidification control portion 50 then generates humidification drive data that drives the wetting liquid heat resistors 11*w* using the humidification drive pattern generation portion 60 according to the recording sheet size data inputted therein from the control portion 44.

For example, when the size of the recording sheet 2 or the number of sheets to be printed is larger a preliminarily set threshold value, the humidification control portion 50 generates humidification drive data to increase an amount of humidification by increasing the resolution (density) at which the wetting liquid droplets w are ejected. When the size of the recording sheet 2 or the number of sheets to be printed is smaller than the preliminarily set threshold value, because a print time is so short that drying and thickening hardly occur during the printing, the humidification control portion 50 generates humidification drive data to reduce an amount of humidification of the wetting liquid droplets w by decreasing the resolution (density) at which the wetting liquid droplets w are ejected.

To be more concrete, when the size of the recording sheet 2 or the number of sheets to be printed is larger than the preliminarily set threshold value, the humidification control portion 50 generates humidification drive data to eject one wetting liquid droplet w at a time at the density of 600 dpi independently of the content of a print image. On the contrary, when the size of the recording sheet 2 or the number of sheets to be printed is smaller than the preliminarily set threshold value, the humidification control portion 50 generates humidification drive data to eject one wetting liquid droplet w at a time at the density of 200 dpi independently of the content of a print image.

The humidification control portion 50 then outputs the humidification drive data generated by the humidification drive pattern generation portion 60 to the wetting liquid heat resistors 11*w* and drives the wetting liquid heat resistors 11*w*. The humidification control portion 50 may be configured in such a manner that an amount of humidification of the wetting liquid droplets w is varied by varying the number of ejection times of the wetting liquid droplets w with the size of the recording sheet 2 or the number of sheets to be printed.

The printer device 1*d* having the configuration as above ejects the wetting liquid droplets w onto the recording sheet 2 transported into a space between the head cartridge 3 and the platen plate 20 by the transportation mechanism 21 across the entire range of the nozzle line 15*w* at a constant amount of humidification that best suits the type of the recording sheet 2, to be more specific, the size of the recording sheet 2 or the number of sheets to be printed, independently of the content of a print image. Because the wetting liquid droplets w ejected onto the recording sheet 2 evaporate from the recording sheet 2, the printer device 1*d* is able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and the vicinities thereof across the entire range at a constant amount of humidification that best suits the size of the recording sheet 2 or the number of sheets to be printed during the printing.

The printer device 1*d* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by performing humidification at a constant amount of humidification that best suits the size of the recording sheet 2 or the number of sheets to be printed, the printer device 1*d* is able to reduce an amount of the used wetting liquid and energy necessary to eject the wetting liquid. Also, the printer device 1*d* is able to prevent smearing and overflow of the inks even when the size of the recording sheet 2 or the number of sheets to be printed is small. Humidification is thus performed effectively.

An embodiment of the present invention is not limited to a type configured to eject the wetting liquid droplets w across the entire range of the recording sheet 2 at a constant amount of humidification independently of the content of a print image during the printing as the printer device 1. It may be configured in such a manner that an amount of humidification of the wetting liquid droplets w is varied with the content of a print image. To be more concrete, the wetting liquid droplets w may be ejected in a region where the nozzle line 15*y* provided uppermost stream in the transportation direction of the recording sheet 2 does not eject the ink onto the recording sheet 2, that is, a non-print region.

Hereinafter, a printer device 1*e* configured to eject the wetting liquid droplets w in a region where the nozzle line 15*y* provided uppermost stream in the transportation direction of the recording sheet 2 does not eject the ink onto the recording sheet 2 will be described. Because the printer device 1*e* has the same configuration as the printer device 1 described above, descriptions are omitted by labeling the same components with the same reference numerals.

Figure 12:
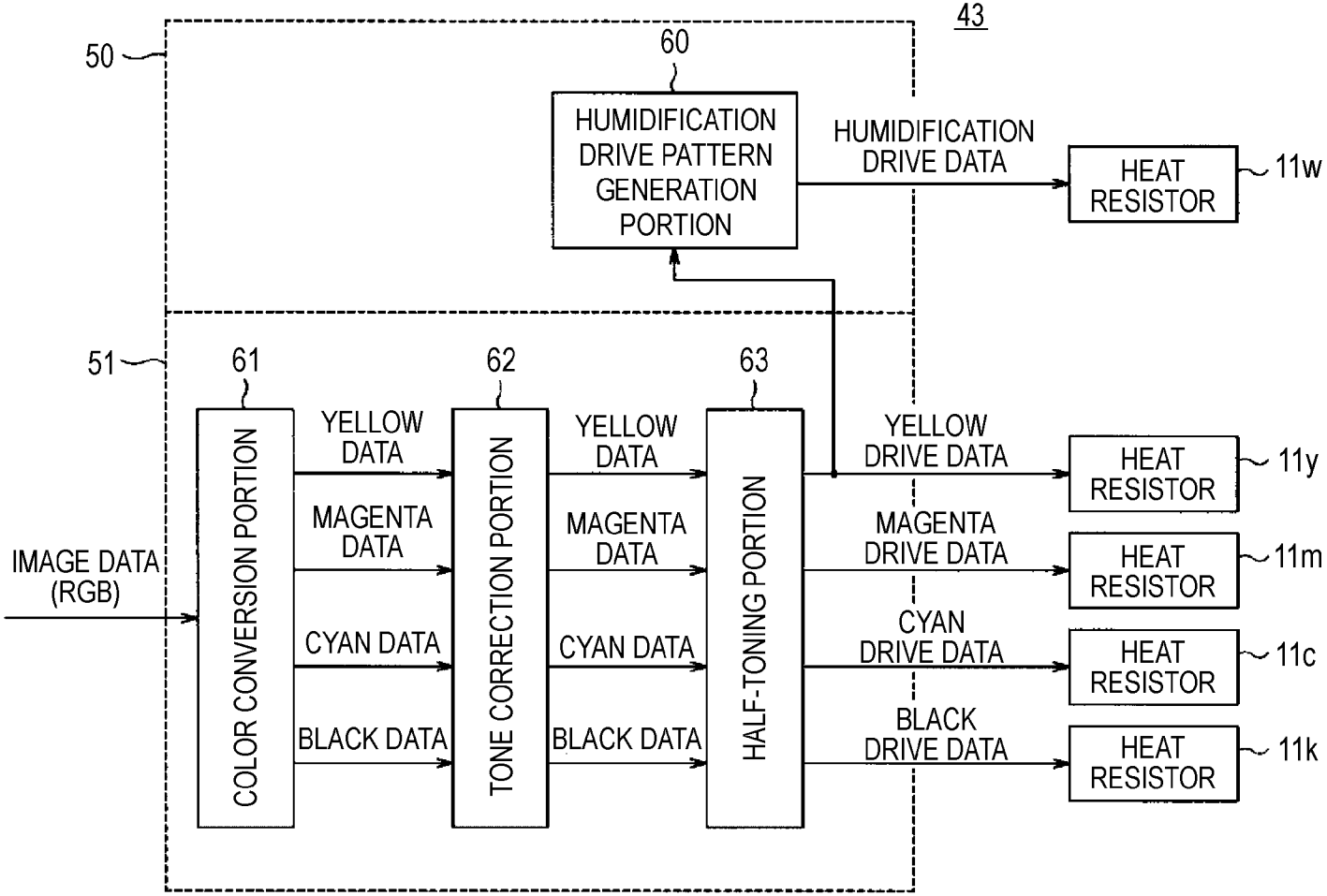
FIG. 12 is a block diagram of the ejection control portion when wetting liquid droplets are ejected in a region where a nozzle line provided uppermost upstream in the transportation direction of the recording sheet does not eject the ink onto the recording sheet and when a larger amount of the wetting liquid droplets are ejected in a region where a nozzle line provided uppermost stream in the transportation direction of the recording sheet does not eject the ink on the recording sheet than in a region where the ink is ejected.

More specifically, according to the humidification method of the printer device 1 described above, as is shown in FIG. 12, the ink control portion 51 converts the print data inputted from an external information processing device via the control portion 44 to color data of four colors corresponding to the ink colors, that is, yellow (Y), magenta (M), cyan (C), and black (K), using the color conversion portion 61. The ink control portion 51 then applies a tone correction to the color data converted by the color conversion portion 61 using the tone correction portion 62. Subsequently, the ink control portion 51 converts the color data after the tone correction by the tone correction portion 62 to ink drive data that drives the heat resistors 11*y*, 11*m*, 11*c*, and 11*k* of the respective colors using the half-toning portion 63. The ink control portion 51 then outputs the ink drive data of the yellow heat resistors 11*y* provided uppermost stream in the transportation direction of the recording sheet 2 to the humidification control portion 50. Herein, the first through sixth print regions 70, 71, 72, 73, 74, and 75 shown in FIG. 7 are described as print regions corresponding to yellow in the print image.

Figure 13:
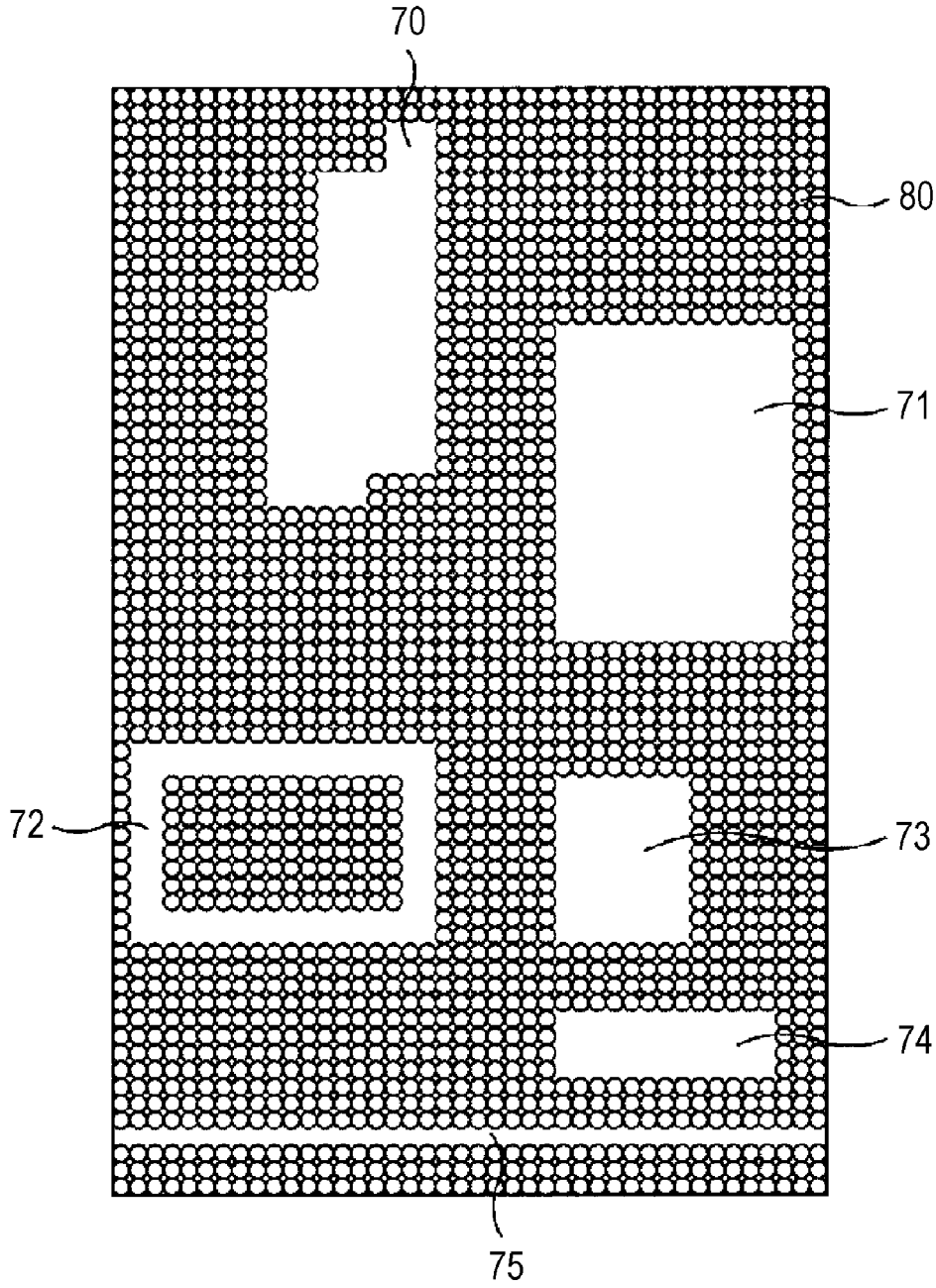
FIG. 13 is a view showing an example of humidification drive data when the wetting liquid droplets are ejected in a region where a nozzle line provided uppermost stream in the transportation direction of the recording sheet does not eject the ink onto the recording sheet.

The humidification control portion 50 detects a non-print region 80 as shown in FIG. 13 not corresponding to yellow other than the first through sixth print regions 70, 71, 72, 73, 74, and 75 corresponding to yellow as shown in FIG. 7 in the print image using the humidification drive pattern generation pattern 60 according to the ink drive data of the yellow heat resistors 11*y* inputted therein from the ink control portion 51. The humidification control portion 50 then generates humidification drive data to eject the wetting liquid droplets w by driving the wetting liquid heat resistors 11*w* in the non-print region 80 as shown in FIG. 13. Subsequently, the humidification control portion 50 outputs the humidification drive data corresponding to the humidification position generated by the humidification drive pattern generation portion 60 to the wetting liquid heat resistors 11*w* and drives the heat resistors 11*w*.

According to the humidification method of the printer device 1 described above, the ink control portion 51 outputs the ink drive data corresponding to the print position to the heat resistors 11*y*, 11*m*, 11*c*, and 11*k* of the respective colors and drives the heat resistors 11*y*, 11*m*, 11*c*, and 11*k*.

The ink control portion 51 ejects ink droplets onto the recording sheet 2 from the yellow nozzle line 15*y*, the magenta nozzle line 15*m*, the cyan nozzle line 15*c*, and the black nozzle line 15*k* and prints a print image by recording the print image according to the print data on the recording sheet 2.

The printer device 1*e* having the configuration as above ejects the wetting liquid droplets w onto the recording sheet 2 transported into a space between the head cartridge 3 and the platen plate 20 by the transportation mechanism 21 in the non-print region 80 not corresponding to yellow other than the first through sixth print regions 70, 71, 72, 73, 74, and 75 corresponding to yellow in the print image. Consequently, even when the yellow nozzle line 15*y* provided uppermost stream in the transportation direction of the recording sheet 2 among the inks of the respective colors does not eject the ink, because the wetting liquid droplets w ejected onto the recording sheet 2 evaporate from the recording sheet 2, the yellow nozzle line 15*y* is humidified. The printer device 1*e* is therefore able to prevent drying and thickening of the ink on the ejection surface 12. Also, even when the magenta, cyan, and black nozzle lines 15*m*, 15*c*, and 15*k* provided side by side downstream of the yellow nozzle line 15*y* in the transportation direction of the recording sheet 2 do not eject the inks, because either the wetting liquid or the yellow ink evaporates from the recording sheet 2, the ejection surface 12 is humidified. It thus becomes possible to prevent drying and thickening of the inks on the ejection surface 12.

The printer device 1*e* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by ejecting the wetting liquid only in the non-print region 80 not corresponding to yellow, the printer device 1*e* is able to reduce an amount of the used wetting liquid and energy necessary to eject the wetting liquid. Hence, not only can humidification be performed effectively, but also smearing and overflow of the inks can be prevented.

An embodiment of the present invention is not limited to the type configured to eject the wetting liquid droplets w onto the recording sheet 2 only in a region where the nozzle line 15*y* provided uppermost stream in the transportation direction of the recording sheet 2 does not eject the ink. It may be configured in such a manner that a larger amount of the wetting liquid droplets w are ejected in this region than in a region where the ink is ejected.

Hereinafter, a printer device if configured to eject a larger amount of the wetting liquid droplets w in a region of the recording sheet 2 where the nozzle line 15*y* provided uppermost stream in the transportation direction of the recording sheet 2 does not eject the ink than in a region where the nozzle 15*y* ejects the ink will be described. Because the printer device if is the same as the printer device 1*e* described above up to the point where the ink drive data of the nozzle line 15*y* is outputted to the humidification control portion 50, descriptions up to this point are omitted.

Figure 14:
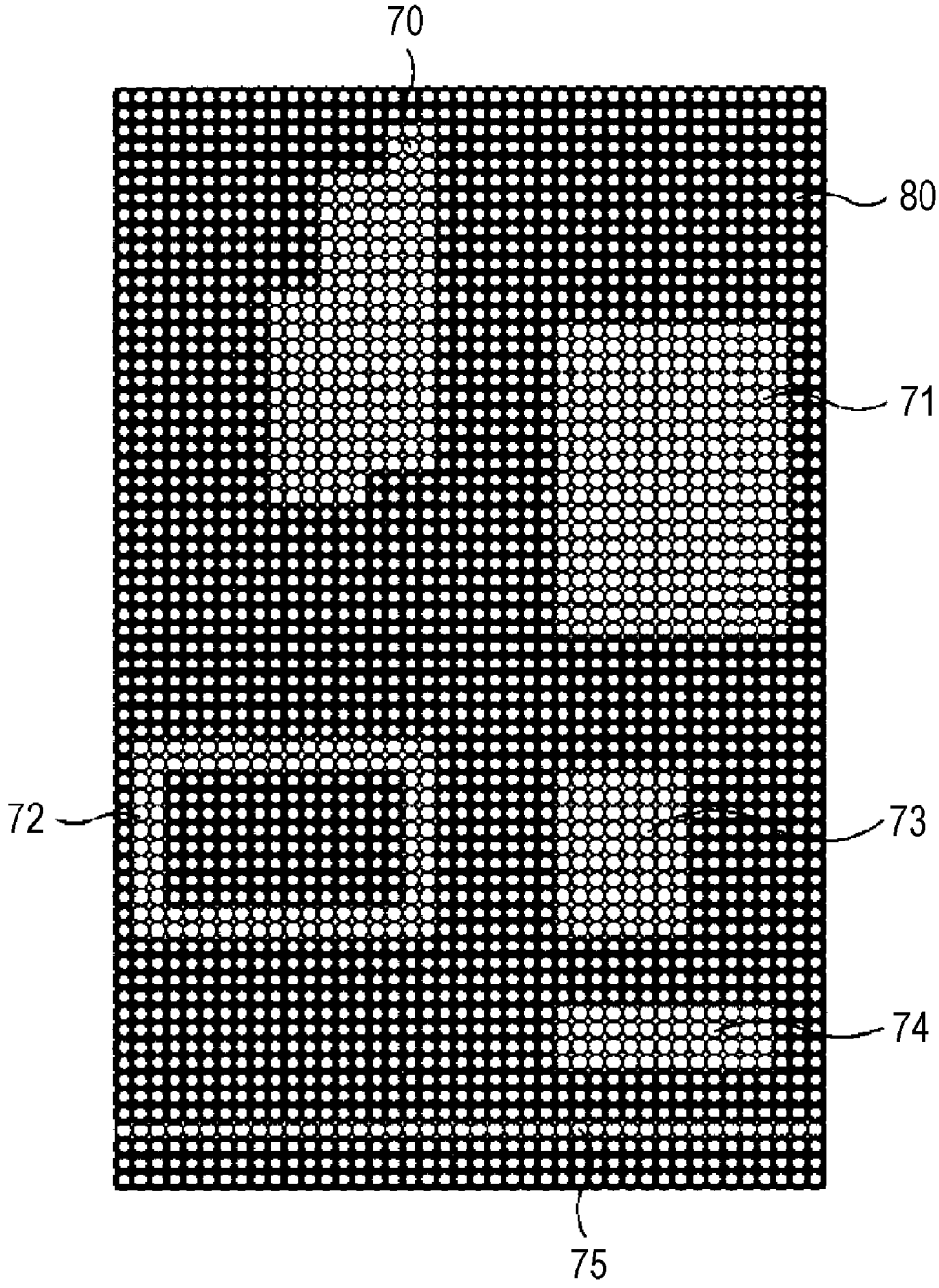
FIG. 14 is a view showing an example of humidification drive data when a larger amount of the wetting liquid droplets are ejected in a region where a nozzle line provided uppermost stream in the transportation direction of the recording sheet does not eject the ink onto the recording sheet than in a region where the ink is ejected.

More specifically, according to the humidification method of the printer device 1*e* described above, the humidification control portion 50 generates humidification drive data that drives the wetting liquid heat resistors 11*w* as shown in FIG. 14 so that the wetting liquid droplets w are ejected, for example, twice in the non-print region 80 and the wetting liquid droplets w are ejected, for example, once in the first through sixth print regions 70, 71, 72, 73, 74, and 75. The humidification control portion 50 then outputs the humidification drive data thus generated to the wetting liquid heat resistors 11*w* and drives the heat resistors 11*w*.

The number of ejection times in the non-print region 80 and the first through sixth print regions 70, 71, 72, 73, 74, and 75 can be changed as the necessity arises as long as the number of ejection times in the non-print region 80 is larger than the number of ejection times in the first through sixth print regions 70, 71, 72, 73, 74, and 75 because drying and thickening of the inks can be prevented by ejecting the ink droplets.

The printer device 1*f* having the configuration as above ejects the wetting liquid droplets w onto the recording sheet 2 transported into a space between the head cartridge 3 and the platen plate 20 by the transportation mechanism 21 twice in the non-print region 80 not corresponding to yellow other than the first through sixth print regions 70, 71, 72, 73, 74, and 75 corresponding to yellow in the print image. The printer device 1*f* also ejects the wetting liquid once in the first through sixth print regions 70, 71, 72, 73, 74, and 75 corresponding to yellow. Consequently, even when the yellow nozzle line 15*y* provided uppermost stream in the transportation direction of the recording sheet 2 among the inks of the respective colors does not eject the ink, because the wetting liquid droplets w ejected twice onto the recording sheet 2 evaporate from the recording sheet 2, the yellow nozzle line 15*y* is humidified by the wetting liquid droplets w of more than one ejection time. Hence, drying and thickening of the ink on the ejection surface 12 can be prevented. Also, even when the magenta, cyan, and black nozzle lines 15*m*, 15*c*, and 15*k* provided side by side downstream of the yellow nozzle line 15*y* in the transportation direction of the recording sheet 2 do not eject the inks, because either the wetting liquid droplets w of two ejection times or the yellow ink droplet plus the wetting liquid droplet w of one ejection time evaporate from the recording sheet 2, the ejection surface 12 is humidified by the wetting liquid droplets w of more than one ejection time. It thus becomes possible to prevent drying or thickening of the inks on the ejection surface 12.

The printer device if is therefore able to prevent drying and thickening of the respective inks on the ejection surface 12 during the printing. The head cartridge 3 thus becomes able to prevent an ejection failure and the curving of an ejection direction caused by drying or thickening of the ink during the printing.

Also, by ejecting the wetting liquid twice in the non-print region 80 not corresponding to yellow and by ejecting the wetting liquid once in the first through sixth print regions 70, 71, 72, 73, 74, and 75 corresponding to yellow, the printer device if becomes able to reduce an amount of the used wetting liquid and energy necessary to eject the wetting liquid. Humidification is thus performed effectively.

Alternatively, an amount of the wetting liquid droplets w may be varied with the content of a print image. To be more concrete, an amount of the wetting liquid droplets w may be varied with an allowable amount of droplets per unit area acceptable by the ink droplets and the wetting liquid droplets w of the recording sheet 2.

Hereinafter, a printer device 1*g* configured to eject the wetting liquid droplet w onto the recording sheet 2 by varying an amount of humidification of the wetting liquid droplets w with an allowable amount of droplets per unit area acceptable by the ink droplets and the wetting liquid droplets w of the recording sheet 2 will be described. Because the printer device 1*g* has the same configuration as the printer device 1 described above, descriptions are omitted by labeling the same components with the same reference numerals.

More specifically, according to the humidification method of the printer device 1 described above, upon input of the print data from an external information processing device, the control portion 44 detects the type of the recording sheet 2 on which a print image is to be printed according to the inputted print data. The control portion 44 then reads out allowable droplet amount data specifying an allowable amount of droplets per unit area acceptable by the ink droplets and the wetting liquid droplets w of the recording sheet 2 thus detected, for example, from the recording portion 40 and outputs the allowable droplet amount data to the humidification control portion 50.

Figure 15:
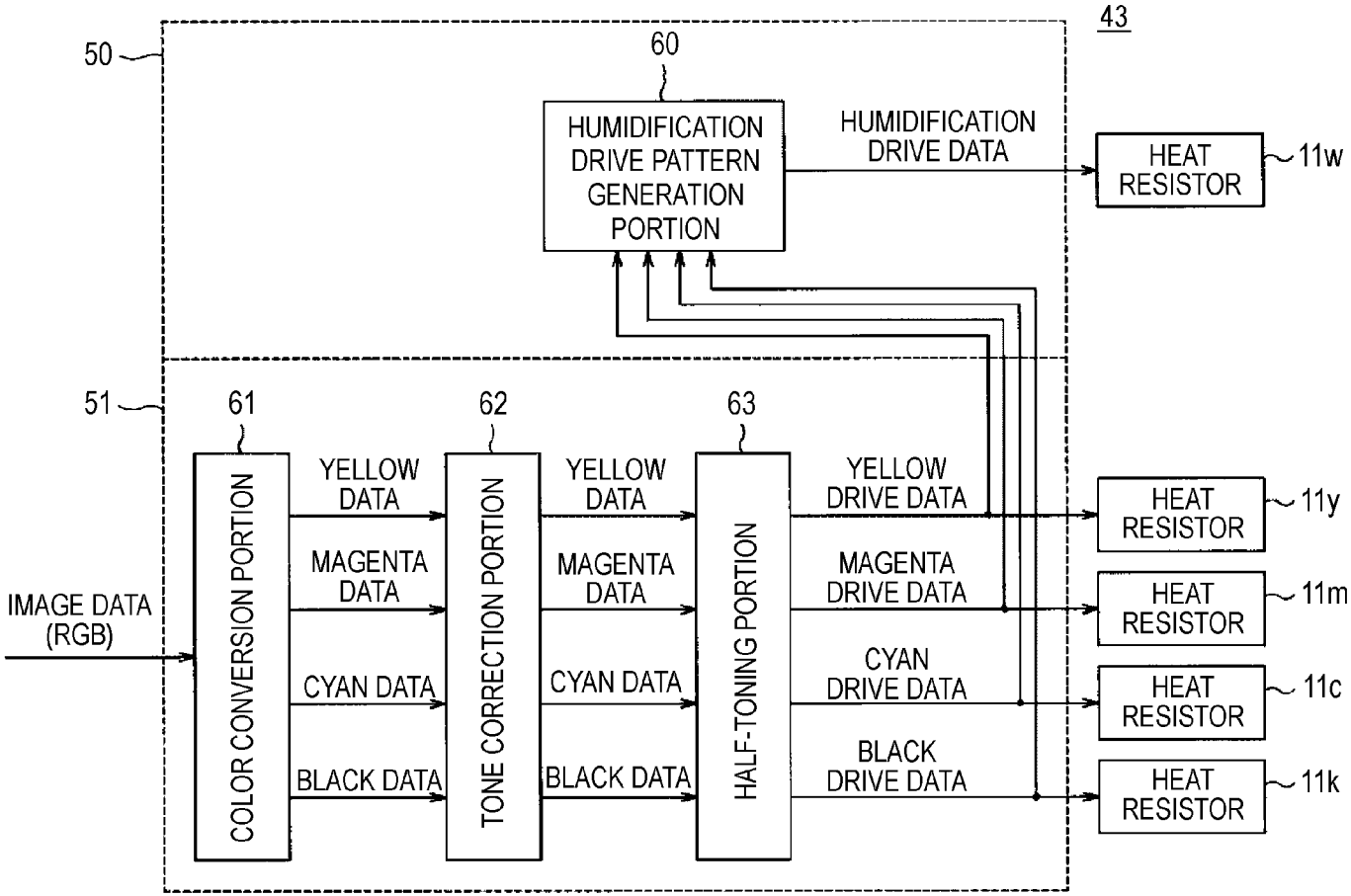
FIG. 15 is a block diagram of the ejection control portion when the wetting liquid droplets are ejected in a region where an amount of humidification of the ink does not reach an allowable number of droplets per unit area of the recording sheet.

Also, as is shown in FIG. 15, the ink control portion 51 converts the print data inputted therein from an external information processing device via the control portion 44 to color data of four colors corresponding to the ink colors, that is, yellow, magenta, cyan, and black, using the color conversion portion 61. The ink control portion 51 then applies a tone correction on the color data converted by the color conversion portion 61 using the tone correction portion 62.

The ink control portion 51 subsequently converts the color data after the tone correction by the tone correction portion 62 to ink drive data that drives the heat resistors 11*y*, 11*m*, 11*c*, and 11*k* of the respective colors using the half-toning portion 63. The ink control portion 51 then outputs the ink drive data of the respective colors to the humidification control portion 50.

The humidification control portion 50 detects a region not having an allowable number of droplets where an amount of humidification of the ink ejected onto the recording sheet 2 does not reach an allowable number of droplets per unit area of the recording sheet 2 using the humidification drive pattern generation portion 60 according to the allowable droplet amount data inputted from the control portion 44 and the ink drive data of the heat resistors 11 of the respective colors inputted from the ink control portion 51. The humidification control portion 50 generates humidification drive data to eject the wetting liquid droplets w to the extent not to exceed an allowable number of droplets of the recording sheet 2 by driving the wetting liquid heat resistors 11*w* in the region not having an allowable number of droplets. The humidification control portion 50 then outputs the humidification drive data corresponding to the humidification position generated by the humidification drive pattern generation portion 60 to the wetting liquid heat resistors 11*w* and drives the wetting liquid heating resistors 11*w*.

According to the humidification method of the printer device 1 described above, the ink control portion 51 outputs the ink drive data corresponding to the print position to the heat resistors 11*y*, 11*m*, 11*c*, and 11*k* of the respective colors and drives the heat resistors 11*y*, 11*m*, 11*c*, and 11*k*.

The ink control portion 51 then ejects the ink droplets onto the recording sheet 2 from the yellow nozzle line 15*y*, the magenta nozzle line 15*m*, the cyan nozzle line 15*c*, and the black nozzle line 15*k* and prints a print image by recording the print image according to the print data on the recording sheet 2.

The printer device 1*g* having the configuration as above ejects the wetting liquid onto the recording sheet 2 transported into a space between the head cartridge 3 and the platen plate 20 by the transportation mechanism 21 to the extent not to exceed an allowable number of droplets of the recording sheet 2 in the region not having an allowable number of droplets where an amount of humidification of the ink ejected onto the recording sheet 2 does not reach an allowable number of droplets per unit area of the recording sheet 2. Because the wetting liquid droplets w ejected onto the recording sheet 2 evaporate from the recording sheet 2, the printer device 1*g* is able to humidify the yellow, magenta, cyan, and black nozzle lines 15*y*, 15*m*, 15*c*, and 15*k* provided side by side downstream of the wetting liquid nozzle line 15*w* in the transportation direction of the recording sheet 2 and the vicinities thereof without exceeding an allowable number of droplets per unit area.

The printer device 1*g* is therefore able to prevent drying and thickening of the respective inks on the ejection surface 12 during the printing. The head cartridge 3 thus becomes able to prevent an ejection failure and the curving of an ejection direction caused by drying or thickening of the inks during the printing.

Also, by performing humidification at an amount of humidification that best suits the content of a print image and an allowable number of droplets per unit area of the recording sheet 2, the printer device 1*g* is able to reduce an amount of the used wetting liquid and energy necessary to eject the wetting liquid. Also, because the wetting liquid will not exceed an allowable number of droplets per unit area, the printer device 1*g* is able to prevent smearing and overflow of the inks. Humidification is thus performed effectively.

It should be appreciated that the printer devices 1, 1*a*, 1*b*, 1*c*, 1*d*, 1*e*, 1*f* and 1*g* are not limited to a type configured in such a manner that one wetting liquid nozzle line 15*w* is provided uppermost stream in the transportation direction of the recording sheet 2. For example, in a case where ink that readily dries or thickens is used, the wetting liquid nozzle line 15*w* may be provided upstream of the ink of the color to be humidified intensively in the transportation direction of the recording sheet 2.

In other words, the printer devices 1, 1*a*, 1*b*, 1*c*, 1*d*, 1*e*, 1*f* and 1*g* may be configured in such a manner that the wetting liquid nozzle line 15*w* is provided, for example, upstream of the black nozzle line 15*k* in the transportation direction of the recording sheet 2. When configured in this manner, the printer devices 1, 1*a*, 1*b*, 1*c*, 1*d*, 1*e*, 1*f* and 1*g* are able to humidify the black nozzle line 15*k* intensively. It thus becomes possible to prevent drying and thickening of the black ink on the ejection surface 12 during the printing.

Also, the printer devices 1, 1*a*, 1*b*, 1*c*, 1*d*, 1*e*, 1*f* and 1*g* may be configured in such a manner that the wetting liquid nozzle line 15*w* is provided upstream of each of the yellow nozzle line 15*y* and the black nozzle line 15*k* in the transportation direction of the recording sheet 2. When configured in this manner, the printer devices 1, 1*a*, 1*b*, 1*c*, 1*d*, 1*e*, 1*f* and 1*g* are able to humidify the yellow and black nozzle lines 15*y* and 15*k* intensively. It thus becomes possible to prevent drying and thickening of the yellow and black inks on the ejection surface 12.

Further, the printer devices 1, 1*a*, 1*b*, 1*c*, 1*d*, 1*e*, 1*f* and 1*g* may be configured in such a manner that the wetting liquid nozzle line 15*w* is provide upstream of each of the nozzle lines 15*y*, 15*m*, 15*c*, and 15*k* of the respective colors attached to the head cartridge 3 in the transportation direction of the recording sheet 2. When configured in this manner, the printer devices 1, 1*a*, 1*b*, 1*c*, 1*d*, 1*e*, 1*f* and 1*g* are able to humidify the nozzle lines 15*y*, 15*m*, 15*c*, and 15*k* of the respective colors intensively. It thus becomes possible to prevent drying and thickening of the inks of the respective colors on the ejection surface 12 during the printing in a more reliable manner.

Also, the printer devices 1, 1*a*, 1*b*, 1*c*, 1*d*, 1*e*, 1*f* and 1*g* are not limited to a so-called multi-line ink jet printer device in which the yellow, cyan, magenta, black, and wetting liquid ink cartridges 10 are attached to a single head cartridge 3. Each ink cartridge may be provided to an independent head cartridge 3.

The printer devices 1, 1*a*, 1*b*, 1*c*, 1*d*, 1*e*, 1*f* and 1*g* are not limited to a line head printer device and each may be a serial head ink jet printer device. Even in the case of a serial head ink jet printer device, by ejecting the wetting liquid droplets w onto the recording sheet 2 from the nozzle line 15*w* before the ink droplets are ejected onto the recording sheet 2 from the nozzle lines 15*y*, 15*m*, 15*c*, and 15*k* of the respective colors and letting the wetting liquid droplets w ejected onto the recording sheet 2 evaporate from the recording sheet 2, it becomes possible to humidify the nozzle lines 15*y*, 15*m*, 15*c*, and 15*k* of the respective colors. Hence, even in the case of a serial head ink jet printer device, it is possible to prevent drying and thickening of the respective inks on the ejection surface 12 during the printing. The head cartridge 3 thus becomes able to prevent an ejection failure and the curving of an ejection direction caused by drying or thickening of the inks during the printing.

The wetting liquid may not be struck depending on the content of printing, for example, in the edge portion of character data or the edge portion of a ruled line where it is particularly desirable to avoid smearing.

Although descriptions are omitted due to complexity, drying and thickening of the respective inks on the ejection surface 12 during the printing may be prevented by changing the humidification pattern by combining a plurality of examples described above, for example, by changing the humidification pattern under the conditions, such as the humidity and the print rate, with the content of printing.

The examples above described a case where heat resistors are used as the pressure generation elements. However, other pressure elements, such as piezo elements can be used as well. Further, it may be configured in such a manner that inks are ejected with an application of an electrostatic field instead of using the pressure generation element.

The examples above described a method of changing the number of droplets or the resolution of the droplet striking pattern in order to control an amount of the wetting liquid. However, a method of changing the droplet size itself can be used as well. The droplet size can be changed by various methods, for example, a method of using ejection portions having different nozzle diameters, a method of controlling the droplet size with a drive waveform using a piezo element as the pressure generation element, a method of driving the nozzle with double pulses, that is, a sub-pulse and a main pulse, using a pressure generation element and a heat resistor and controlling an amount of ejected liquid by changing the pulse widths and an interval of the two pulses.

In the embodiments of the present invention, the ink cartridges 10 are mounted on the head cartridge 3. However, it may be configured in such a manner that the ink cartridges 10 are mounted on the main body instead of the head cartridge 3 and the inks are supplied to the head cartridge 3 via tubes.

In the embodiments of the present invention, the nozzle lines 15 are aligned in order of yellow, magenta, cyan, and black from upstream to downstream in the transportation direction of the recording sheet 2. However, the order of alignment of the inks is not limited to the order specified above and the number of colors and the types of colors are not limited to those specified above, either.

The present application contains subject matter related to that disclosed in Japanese Priority Patent Application JP 2008-248699 filed in the Japan Patent Office on Sep. 26, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An ink jet printer device comprising:

a recording medium transportation mechanism to transport a recording medium in a transportation direction, an ejection portion with at least one ink cartridge that ejects an ink droplet onto a recording medium via a respective nozzle;

a humidification portion that is provided upstream of the ejection portion in the transportation direction of the recording medium, the humidification portion having a cartridge that ejects a colorless liquid droplet onto the recording medium via a respective nozzle; and a control portion that is configured to control the ejection of the ink droplet onto the recording medium from the ejection portion and the ejection of the liquid droplet onto the recording medium from the humidification portion, wherein, the nozzles of the ejection portion and the humidification portion are aligned along the transportation direction, the nozzle of the humidification portion is disposed upstream relative to the ejection portion with respect to the transportation direction, and the ejection portion is humidified during printing by letting the liquid droplet ejected onto the recording medium evaporate from the recording medium.

2. The ink jet printer device according to claim 1 further comprising:

one or both of a humidity measurement portion that measures a humidity and a temperature measurement portion that measures a temperature, wherein the control portion is configured to control the ejection of the liquid droplet onto the recording medium from the humidification portion by varying an amount and a striking method of the liquid droplet to be ejected from the humidification portion with the humidity measured by the humidity measurement portion and the temperature measured by the temperature measurement portion.

3. The ink jet printer device according to claim 1 further comprising:

a print content detection portion that detects an image to be formed on the recording medium, wherein the control portion is configured to control the ejection of the liquid droplet onto the recording medium from the humidification portion by varying an amount and a striking method of the liquid droplet with the image to be formed on the recording medium detected by the print content detection portion.

4. The ink jet printer device according to claim 3, wherein:

the ejection portion includes a plurality of ink cartridges, the print content detection portion is configured to detect a region where ink is not ejected onto the recording medium by an ink cartridge that is farthest upstream among the plurality of ink cartridges in the transportation direction; and the control portion is configured to control the ejection of the liquid droplet from the humidification portion in the region where the ink cartridge that is farthest upstream does not eject the ink.

5. The ink jet printer device according to claim 3, wherein:

the ejection portion includes a plurality of ink cartridges, the print content detection portion is configured to detect a region ink is not ejected onto the recording medium by an ink cartridge that is farthest upstream among the plurality of ink cartridges in the transportation direction; and the control portion is configured to control the humidification portion such that a larger amount of the liquid droplet is ejected from the humidification portion in the region where the ink cartridge that is farthest upstream does not eject the ink than in a region where the ink is ejected by the ink cartridge that is farthest upstream.

6. The ink jet printer device according to claim 3, wherein:

the print content detection portion is configured to detect an amount of ink per pixel by the ejection portion; and the control portion is configured to control the ejection of the liquid droplet from the humidification portion in a region where the amount of ink per pixel by the ejection portion detected by the print content detection portion does not reach an allowable limit number of droplets per pixel of the recording medium.

7. The ink jet printer device according to claim 1 further comprising:

a recording medium detection portion configured to detect one or more than one of a type of the recording medium, a print rate, and a size of the recording medium, wherein the control portion is configured to control the ejection of the liquid droplet onto the recording medium from the humidification portion by varying an amount of the liquid droplet with the type of the recording medium, the print rate, and the size of the recording medium detected by the recording medium detection portion.

8. The ink jet printer device according to claim 1, wherein:

the liquid is a transparent liquid that is either ink from which a dye component is removed or water.

9. The ink jet printer device according to claim 1, wherein:

an ejection width of the humidification portion is substantially as large as or slightly larger than an ejection width of the ejection portion.

10. A humidification method comprising the steps of:

transporting a recording medium in a transportation direction;

ejecting a colorless liquid droplet from a cartridge onto a recording medium via a nozzle from a humidification portion;

humidifying an ejection portion during printing by letting the liquid droplet ejected onto the recording medium evaporate from the recording medium, ejecting an ink droplet from an ink cartridge onto a recording medium via a nozzle from an ejection portion, wherein, the nozzles of the ejection portion and the humidification portion are aligned along the transportation direction, the nozzle of the humidification portion is disposed upstream relative to the ejection portion with respect to the transportation direction.

* * * * *